US011139618B2

(12) United States Patent
Yang et al.

(10) Patent No.: US 11,139,618 B2
(45) Date of Patent: Oct. 5, 2021

(54) ELECTRICAL MODULE

(71) Applicant: LOTES CO., LTD, Keelung (TW)

(72) Inventors: Qi Xiao Yang, Keelung (TW); Yong Fu Wang, Keelung (TW); Wei Xue Zhong, Keelung (TW); Biao Zhang, Keelung (TW); Jia Xu Yin, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/898,551

(22) Filed: Jun. 11, 2020

(65) Prior Publication Data

US 2021/0159642 A1 May 27, 2021

(30) Foreign Application Priority Data

Nov. 25, 2019 (CN) ..... 201911162467.5

(51) Int. Cl.

| | |
|---|---|
| ***H01R 12/00*** | (2006.01) |
| ***H01R 13/6471*** | (2011.01) |
| ***H01R 12/72*** | (2011.01) |
| ***H01R 12/73*** | (2011.01) |
| ***H01R 13/6477*** | (2011.01) |

(52) U.S. Cl.

CPC ..... *H01R 13/6471* (2013.01); *H01R 12/721* (2013.01); *H01R 12/737* (2013.01); *H01R 13/6477* (2013.01)

(58) Field of Classification Search

CPC ..... H01R 12/721; H01R 12/737; H01R 13/6461; H01R 13/6471; H01R 13/6477

USPC ..... 439/59, 62

See application file for complete search history.

(56) References Cited

U.S. PATENT DOCUMENTS

| | | | | |
|---|---|---|---|---|
| 7,316,570 | B2 | 1/2008 | Ling | |
| 7,794,278 | B2 | 9/2010 | Cohen et al. | |
| 10,541,482 | B2 * | 1/2020 | Sasame | H01R 13/514 |
| 10,601,181 | B2 * | 3/2020 | Lu | H01R 13/6272 |
| 10,777,921 | B2 * | 9/2020 | Lu | H01R 12/82 |

FOREIGN PATENT DOCUMENTS

| | | | |
|---|---|---|---|
| CN | 101162806 | A | 4/2008 |
| CN | 100557901 | C | 11/2009 |
| CN | 204696287 | U | 10/2015 |
| CN | 109314334 | A | 2/2019 |

* cited by examiner

*Primary Examiner* — Khiem M Nguyen

(74) *Attorney, Agent, or Firm* — Locke Lord LLP; Tim Tingkang Xia, Esq.

(57) ABSTRACT

An electrical module is electrically conducted with an electronic component, and includes multiple conductors having a first row of conductors arranged in a left-right direction and an insulating body fixing the first row of conductors. Each conductor has a contact portion in contact with the electronic component. A distance between each two adjacent contact portions of the conductors in the left-right direction is defined as a contact interval. The first row of conductors have at least one pair of signal conductors and at least two ground conductors. Each two adjacent sides of the pair of signal conductors has one ground conductor. The contact interval from one signal conductor to its adjacent ground conductor is defined as a first contact interval. The contact interval from the other signal conductor to its adjacent ground conductor is defined as a second contact interval. The first and second contact intervals are not equal.

25 Claims, 24 Drawing Sheets

A–A

X
Y
G
S2
S1
G
S2
S1
G
S2
S1

C–C

D–D

ELECTRICAL MODULE

CROSS-REFERENCE TO RELATED PATENT APPLICATION

This non-provisional application claims priority to and the benefit of, pursuant to 35 U.S.C. § 119(a), patent application Serial No. CN201911162467.5 filed in China on Nov. 25, 2019. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical module, and particularly to an electrical module with good signal transmission performance.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional electrical module is an insertion slot connector, and has an insulating body. The insulating body has an insertion slot configured for insertion of an electronic card (electronic component). In two side walls forming the insertion slot, each side wall is fixed with one row of terminals. Each row of terminals have a plurality of pairs of signals terminals and a plurality of ground terminals, which are alternately arranged at a same center distance and a same interval. That is, one ground terminal is provided at each of two sides of a pair of signal terminals at equal intervals. Each pair of signal terminals are used to transmit signals. Each ground terminal is used to shield adjacent signal terminals and to reduce crosstalk between adjacent pairs of signal terminals. Further, the electronic card matched with the above insertion slot connector has two rows of pads respectively corresponding the two rows of terminals. Each row of pads have a plurality of pairs of signal pads and a plurality of grounding pads, which are arranged at equal intervals, and are correspondingly in contact with each row of terminals.

However, with the requirements for signal transmission in the field of electrical connectors being increasingly high in recent years, the requirements for the frequencies of signals transmitted by the electrical connectors and the electronic cards are also higher. To stably transmit the high-frequency signals, requirements for preventing crosstalk interference have also been increased. For the above requirements, Chinese Patent No. CN200610096618.8 discloses an electrical connector, having a plurality of ground terminals forming a plurality of ground units, where each ground unit is formed by two adjacent ground terminals; and a plurality of signal terminals forming a plurality of signal units, where each signal unit is formed by two adjacent signal terminals. The signal units and the ground units are alternately arranged at equal intervals. The quantity of the ground terminals between two adjacent signal units is increased, thereby preventing the signal terminals from generating interference, and ensuring the quality of signal transmission of the electrical connector and high-current stable transmission.

U.S. Pat. No. 7,316,570 also discloses an electronic card (electrical module) which is matched and inserted with an insertion slot connector (an electronic component). Each of two sides of the electronic card has a row of pads. The pads at one side are arranged as "SSGGSSGG," and the pads at the other side are arranged as "GGSSGGSS." The crosstalk between the signal pads is reduced by additionally adding grounding pads.

However, by increasing the quantity of the ground terminals, the ground resonance will also be increased. The ground resonance may cause insertion loss and return loss of the signal terminals, and cause the crosstalk to have sharp resonance points, such that the signal transmission of the electrical connector cannot achieve a desired effect. Further, due to the increase of the quantity of the terminals, the material cost for manufacturing the terminals is also increased, and the dimension of an insulating body for fixing the terminals also needs to be increased to correspondingly fix the newly added terminals, which is not conductive to reducing the cost of the electrical connector. Similarly, adding additional grounding pads to the electronic card may cause the same problem.

Therefore, a heretofore unaddressed need to design a new electrical module exists in the art to address the aforementioned deficiencies and inadequacies.

SUMMARY

The present invention is directed to an electrical module which achieves an ideal high-frequency performance effect by adjusting a contact interval or a contact center distance between a pair of signal conductors and a ground conductor.

To achieve the foregoing objective, the present invention adopts the following technical solutions. An electrical module is electrically connected with an electronic component. The electrical module includes: a plurality of conductors, having a first row of conductors arranged along a left-right direction, wherein each of the conductors has a contact portion in contact with the electronic component, a distance between each two adjacent ones of the contact portions of the conductors in the left-right direction is defined as a contact interval, the first row of conductors have at least one pair of signal conductors and at least two ground conductors, each of a left adjacent side and a right adjacent side of the pair of signal conductors has one of the two ground conductors, the contact interval from one signal conductor of the pair of signal conductors to an adjacent one of the two ground conductors is defined as a first contact interval, the contact interval from the other signal conductor of the pair of signal conductors to the other adjacent one of the two ground conductors is defined as a second contact interval, and the first contact interval is not equal to the second contact interval; and an insulating body, fixing the first row of conductors.

In certain embodiments, the contact interval between the pair of signal conductors is defined as a third contact interval, the first contact interval is greater than the second contact interval and also greater than the third contact interval, and the second contact interval is less than or equal to the third contact interval.

In certain embodiments, a first average dielectric coefficient exists between one of the ground conductors and a corresponding one of the signal conductors defining the first contact interval therebetween, a second average dielectric coefficient exists between one of the ground conductors and a corresponding one of the signal conductors defining the second contact interval therebetween, and the first average dielectric coefficient is greater than the second average dielectric coefficient.

In certain embodiments, the electrical module is an electrical connector, the electrical connector is mounted to a circuit board, the electronic component is an electronic card inserted into the electrical connector, and the electrical connector includes: the insulating body, comprising a first side wall and a second side wall provided opposite to each other, and an insertion slot located between the first side wall and the second side wall, wherein the insertion slot is configured for the electronic card to be inserted therein; and the first row of conductors, having a plurality of pairs of signal conductors and a plurality of ground conductors, wherein each of the left adjacent side and the right adjacent side of each pair of the pairs of the signal conductors has one of the ground conductors, the contact portions of the first row of conductors are arranged in one row on the first side wall in the left-right direction, each of the contact portions of the first row of conductors protrudes into the insertion slot, after being in contact with the electronic card, each of the contact portions of the first row of conductors generates an elastic displacement, and before and after the electronic card is inserted into the insertion slot, the first contact interval is greater than the second contact interval.

In certain embodiments, the first side wall has a plurality of partition walls and a plurality of conductor slots, each of the conductor slots is configured to accommodate one of the conductors of the first row of conductors and is in communication with the insertion slot, one of the partition walls is defined between two adjacent ones of the conductor slots, each of the partition walls between one of the ground conductors and a corresponding one of the signal conductors defining the first contact interval therebetween has a first thickness, each of the partition walls between one of the ground conductors and a corresponding one of the signal conductors defining the second contact interval therebetween has a second thickness, and the first thickness is greater than the second thickness.

In certain embodiments, each of the partition walls located between one of the pairs of signal conductors defines a third thickness, and the third thickness is equal to the second thickness.

In certain embodiments, each of the signal conductors has a fixing portion and a connecting portion extending from the fixing portion, and the connecting portion is located between the contact portion and the fixing portion; each respective partition wall of the partition walls located between the two signal conductors of one of the pairs of signal conductors has a window and two fastening slots, the window runs through the respective partition wall in the left-right direction, the two fastening slots are respectively provided at a left and a right side of the respective partition wall, each of the two fastening slots is a blind hole, and the two fastening slots are not in communication with each other in the left-right direction; and the two connecting portions of each of the pairs of signal conductors are located at a left adjacent side and a right adjacent side of the window, the two connecting portions are in air communication, the two fixing portions of each of the pairs of signal conductors are respectively fastened in the two fastening slots, and the two fixing portions are not in air communication.

In certain embodiments, the first side wall has a row of conductor slots arranged in the left-right direction, each of the conductor slots is configured to correspondingly accommodate one of the conductors and is in communication with the insertion slot, the first side wall further comprises a plurality of windows configured to communicate two adjacent ones of the conductor slots in the left-right direction, none of the windows exists in two of the conductor slots corresponding to one of the ground conductors and a corresponding one of the signal conductors defining the first contact interval therebetween, and one of the window exists between two of the conductor slots corresponding to one of the ground conductors and a corresponding one of the signal conductors defining the second contact interval therebetween.

In certain embodiments, each of the conductors has a fixing portion fixed to the insulating body and a tail portion extending out of the insulating body, the fixing portion is located between the contact portion and the tail portion, a distance between each two adjacent ones of the fixing portions of the conductors is defined as a fixing interval, the fixing interval between one of the signal conductors and a corresponding one of the ground conductors defining the first contact interval therebetween is defined as a first fixing interval, the fixing interval between the other of the signal conductors and a corresponding one of the ground conductors defining the second contact interval therebetween is defined as a second fixing interval, the first contact interval is greater than the second contact interval, and the first fixing interval is greater than or equal to the second fixing interval.

In certain embodiments, a distance between each two adjacent ones of the tail portions is defined as a tail interval, the tail interval between the one of the signal conductors and the corresponding one of the ground conductors defining the first contact interval therebetween is defined as a first tail interval, the tail interval between the other of the signal conductors and the corresponding one of the ground conductors defining the second contact interval therebetween is defined as a second tail interval; when the first fixing interval is greater than the second fixing interval, the first tail interval is greater than the second tail interval; and when the first fixing interval is equal to the second fixing interval, the first tail interval is equal to the second tail interval.

In certain embodiments, a width direction is defined to be perpendicular to the left-right direction, the conductors further have a second row of conductors, the second row of conductors and the first row of conductors are parallel in the width direction and provided at intervals oppositely, the first row of conductors and the second row of conductors both have a plurality of pairs of signal conductors and a plurality of ground conductors, at least one of the pairs of signal conductors of the first row of conductors and at least one of the pairs of signal conductors of the second row of conductors are opposite to each other one-by-one in the width direction, and at least one of the ground conductors of the first row of conductors and at least one of the ground conductors of the second row of conductors are staggered one-by-one in the width direction.

In certain embodiments, a width direction is defined to be perpendicular to the left-right direction, the conductors further form a second row of conductors, the second row of conductors and the first row of conductors are parallel in the width direction and provided at intervals oppositely, the first row of conductors and the second row of conductors both have a plurality of pairs of signal conductors and a plurality of ground conductors, and in at least one pair of the pairs of signal conductors of the first row of conductors, one of the one pair of signal conductors is opposite to one of the ground conductors of the second row of conductors in the width direction, and the other of the one pair of signal conductors is not opposite to any conductor of the second row of conductors in the width direction.

In certain embodiments, the electrical module is an electronic card, the electronic component is an electrical connector configured for the electronic card to insert therein, the electronic card comprises an insertion end, configured to be inserted into the electrical module, the insertion end has two plate surfaces parallel and opposite to each other, and the first row of conductors are provided on one of the plate surfaces.

To achieve the foregoing objective, the present invention further adopts the following technical solutions. An electrical module is electrically connected with an electronic component. The electrical module includes: a plurality of conductors, having a first row of conductors in a left-right direction, wherein each of the conductors has a contact portion in contact with the electronic component, a center distance between each two adjacent ones of the contact portions of the conductors in the left-right direction is defined as a contact center distance, the conductors have at least one ground unit and at least two pairs of signal conductors, each of the at least one ground unit is formed by at least one ground conductor, each of a left adjacent side and a right adjacent side of the ground unit is provided with a corresponding pair of the at least two pairs of signal conductors, the contact center distance from one of the at least one ground conductor of the ground unit to an adjacent signal conductor of the corresponding pair of the at least two pairs of signal conductors at one of the adjacent sides of the ground unit is defined as a first contact center distance, and the contact center distance from one of the at least one ground conductor of the ground unit to an adjacent signal conductor of the corresponding pair of the at least two pairs of signal conductors at the other of the adjacent sides of the ground unit is defined as a second contact center distance, and the first contact center distance is not equal to the second contact center distance; and an insulating body, fixing the first row of conductors.

In certain embodiments, the contact center distance between each pair of the at least two pairs of signal conductors is equal and is defined as a third contact center distance, the first contact center distance is greater than the second contact center distance and also greater than the third contact center distance, and the second contact center distance is less than or equal to the third contact center distance.

In certain embodiments, the electrical module is an electrical connector, the electrical connector is mounted to a circuit board, the electronic component is an electronic card inserted into the electrical connector, and the electrical connector includes: the insulating body, comprising a first side wall and a second side wall provided opposite to each other, and an insertion slot located between the first side wall and the second side wall, wherein the insertion slot is configured for the electronic card to be inserted therein; and the first row of conductors, having a plurality of pairs of signal conductors and a plurality of ground conductors, wherein each of a left adjacent side and a right adjacent side of each of the ground units is provided with one pair of signal conductors, the contact portions of the first row of conductors are arranged in one row on the first side wall in the left-right direction, each of the contact portions of the first row of conductors protrudes into the insertion slot, after being in contact with the electronic card, each of the contact portions of the first row of conductors generates an elastic displacement, and before and after the electronic card is inserted into the insertion slot, and before and after the electronic card is inserted into the insertion slot, the first contact center distance is greater than the second contact center distance.

In certain embodiments, the first side wall has a plurality of partition walls and a plurality of conductor slot, each of the conductor slots is in communication with the insertion slot and is configured to accommodate each of the first row of conductors, one of the partition walls is defined between two adjacent ones of the conductor slots, each of the partition walls between one of the ground conductors and a corresponding one of the signal conductors defining the first contact center distance therebetween has a first thickness, each of the partition walls between one of the ground conductors and a corresponding one of the signal conductors defining the second contact center distance therebetween has a second thickness, and the first thickness is greater than the second thickness.

In certain embodiments, each of the partition walls located between one of the pairs of signal conductors defines a third thickness, and the third thickness is equal to the second thickness.

In certain embodiments, each of the signal conductors has a fixing portion and a connecting portion extending from the fixing portion, and the connecting portion is located between the contact portion and the fixing portion; each respective partition wall of the partition walls located between one of the pairs of signal conductors has a window and two fastening slots, the window is located between the two connecting portions and runs through the respective partition wall in the left-right direction, the two fastening slots are respectively provided at a left and a right side of the respective partition wall, each of the two fastening slots is fastened and matched with one of the fixing portions of the one of the pairs of signal conductors, each of the two fastening slots is a blind hole, and the two fastening slots are not in communication with each other in the left-right direction.

In certain embodiments, the first side wall has a row of conductor slots arranged in the left-right direction, each of the conductor slots is in communication with the insertion slot and is configured to correspondingly accommodate each of the first row of conductors, the first side wall further comprises a plurality of windows configured to communicate two adjacent ones of the conductor slots in the left-right direction, none of the windows exists in two of the conductor slots corresponding to one of the ground conductors and a corresponding one of the signal conductors defining the first contact center distance therebetween, and one of the window exists between two of the conductor slots corresponding to one of the ground conductors and a corresponding one of the signal conductors defining the second contact center distance therebetween.

In certain embodiments, each of the conductors has a fixing portion fixed to the insulating body and a tail portion extending out of the insulating body, the fixing portion is located between the contact portion and the tail portion, a center distance between each two adjacent ones of the fixing portions of the conductors is defined as a fixing center distance, the fixing center distance between one of the signal conductors and a corresponding one of the ground conductors defining the first contact center distance therebetween is defined as a first fixing center distance, the fixing center distance between the other of the signal conductors and a corresponding one of the ground conductors defining the second contact center distance therebetween is defined as a second fixing center distance, the first contact center distance is greater than the second contact center distance, and the first fixing center distance is greater than or equal to the second fixing center distance.

In certain embodiments, a center distance between each two adjacent ones of the tail portions is defined as a tail center distance, the tail center distance between the one of the signal conductors and the corresponding one of the ground conductors defining the first contact center distance therebetween is defined as a first tail center distance, the tail center distance between the other of the signal conductors and the corresponding one of the ground conductors defining the second contact center distance therebetween is defined as a second tail center distance; when the first fixing center distance is greater than the second fixing center distance, the first tail center distance is greater than the second tail center distance; and when the first fixing center distance is equal to the second fixing center distance, the first tail center distance is equal to the second tail center distance.

In certain embodiments, a width direction is defined to be perpendicular to the left-right direction, the conductors further have a second row of conductors, the second row of conductors and the first row of conductors are parallel in the width direction and provided at intervals oppositely, the first row of conductors and the second row of conductors both have a plurality of pairs of signal conductors and a plurality of ground units, at least one of the pairs of signal conductors of the first row of conductors and at least one of the pairs of signal conductors of the second row of conductors are opposite to each other one-by-one in the width direction, and at least one of the ground units of the first row of conductors and at least one of the ground units of the second row of conductors are staggered one-by-one in the width direction.

In certain embodiments, a width direction is defined to be perpendicular to the left-right direction, the conductors further form a second row of conductors, the second row of conductors and the first row of conductors are parallel in the width direction and provided at intervals oppositely, the first row of conductors and the second row of conductors both have a plurality of pairs of signal conductors and a plurality of ground units, each of the ground units only has one ground conductor, and in at least one pair of the pairs of signal conductors of the first row of conductors, one of the one pair of signal conductors is opposite to one of the ground units of the second row of conductors in the width direction, and the other of the one pair of signal conductors is not opposite to any conductor of the second row of conductors in the width direction.

In certain embodiments, the electrical module is an electronic card, the electronic component is an electrical connector configured for the electronic card to insert therein, the electronic card comprises an insertion end, configured to be inserted into the electrical module, the insertion end has two plate surfaces parallel and opposite to each other, and the first row of conductors are provided on one of the plate surfaces.

Compared with the related art, certain embodiments of the present invention have the following beneficial effects.

Compared with the related art, in which one row of terminals of the electrical module are provided at equal center distances and equal intervals, the electrical module according to certain embodiments of the present embodiment has the beneficial effects that the first contact center distance is greater than the second contact center distance, and the first contact interval is greater than the second contact interval, such that in each conductive unit, an average contact center distance and an average contact interval from two ground conductors to a pair of signal conductors are increased, thereby reducing the resonance to the first signal conductors from the adjacent ground conductors, increasing the center distances between the two ground conductors at two sides of the pair of signal conductors, reducing overlapping of interfering electromagnetic waves of the two ground conductors adjacent to the pair of signal conductors, and then reducing the ground resonance. Further, the impedance of the pair of signal conductors is reduced, such that when a high-frequency signal is transmitted from the electronic card to the conductors, the energy of the high-frequency signal is more easily transmitted through the pair of signal conductors, thereby reducing the insertion loss, and facilitating the high-frequency performance. Meanwhile, more energy of the high-frequency signal is transmitted through the pair of signal conductors. The pair of signal conductors for transmitting a differential signal has anti-crosstalk characteristics. By having more energy to be transmitted through the pair of signal conductors, the anti-crosstalk effect of the electrical connector is better.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
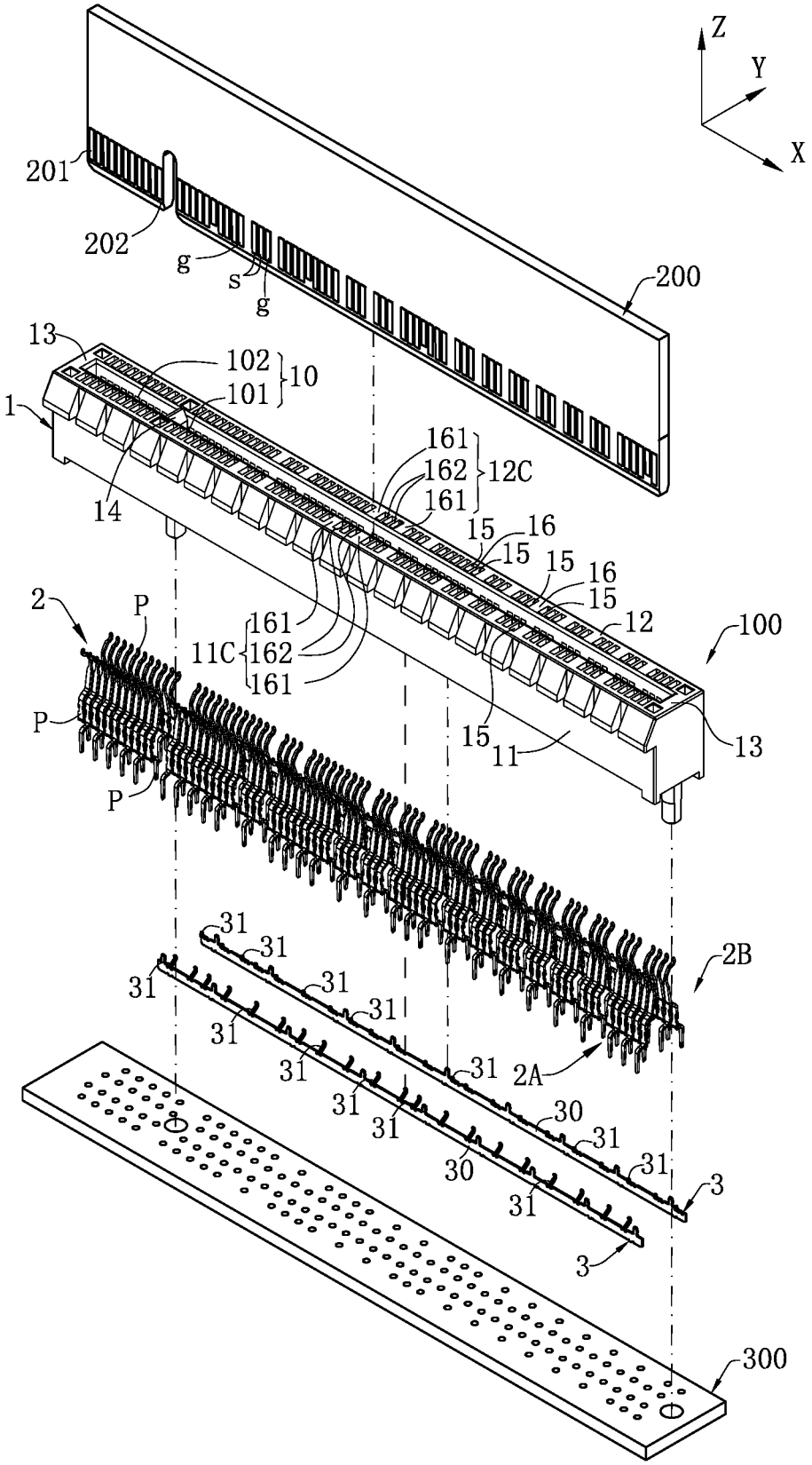
FIG. 1 is a perspective exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-24. In accordance with the purposes of this invention, as embodied and broadly described herein, this invention, in one aspect, relates to an electrical module.

To better understand the technical solutions of the present invention more conveniently, in the three-dimensional coordinates as shown in the drawings, a Z-axis is defined as a vertical direction, an X axis is defined as a left-right direction, and a Y axis is defined as a width direction. The width direction Y is defined to be perpendicular to the left-right direction X and the vertical direction Y.

Figure 2:
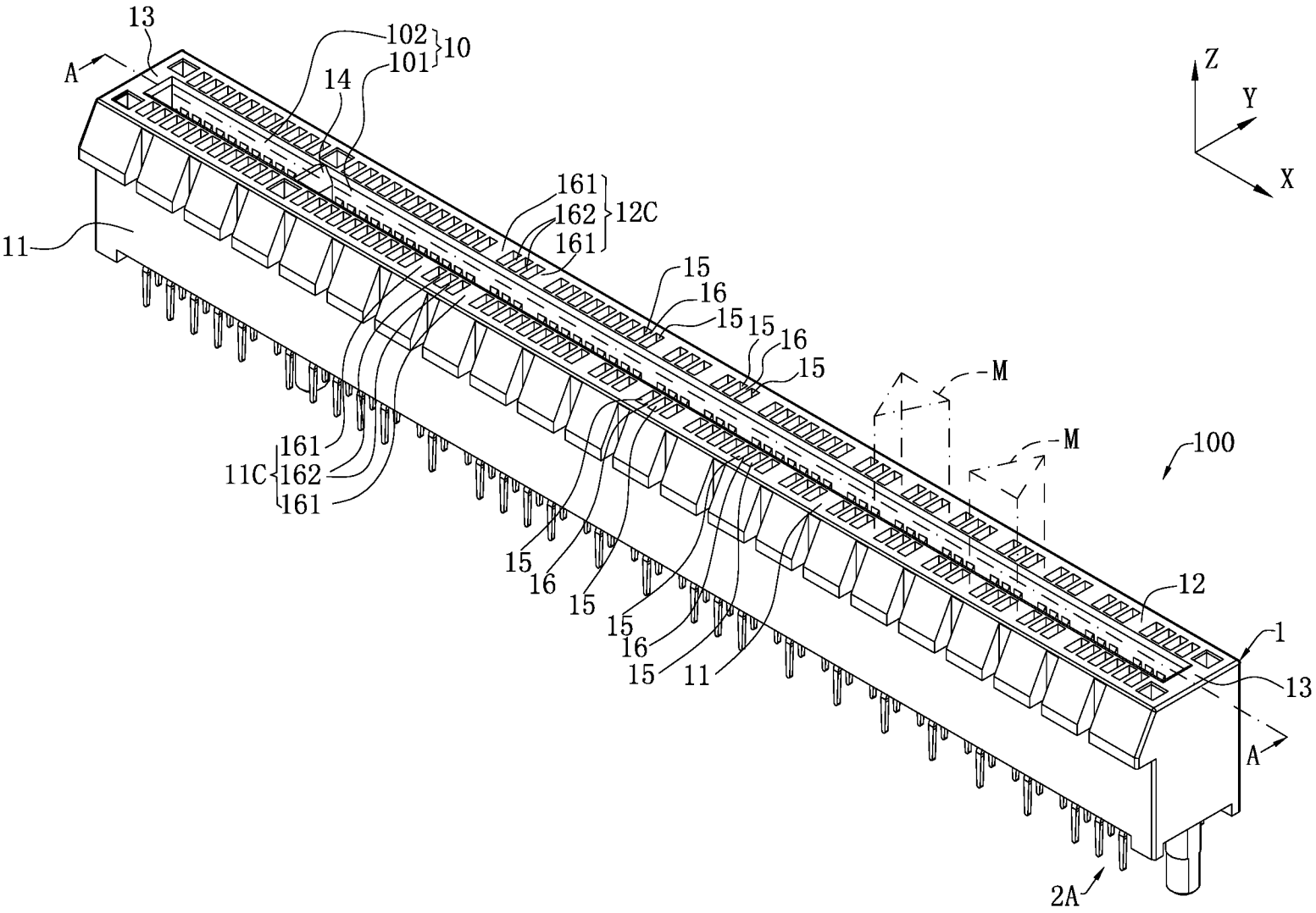
FIG. 2 is a perspective assembled view of the electrical connector according to the first embodiment of the present invention.
Figure 6:
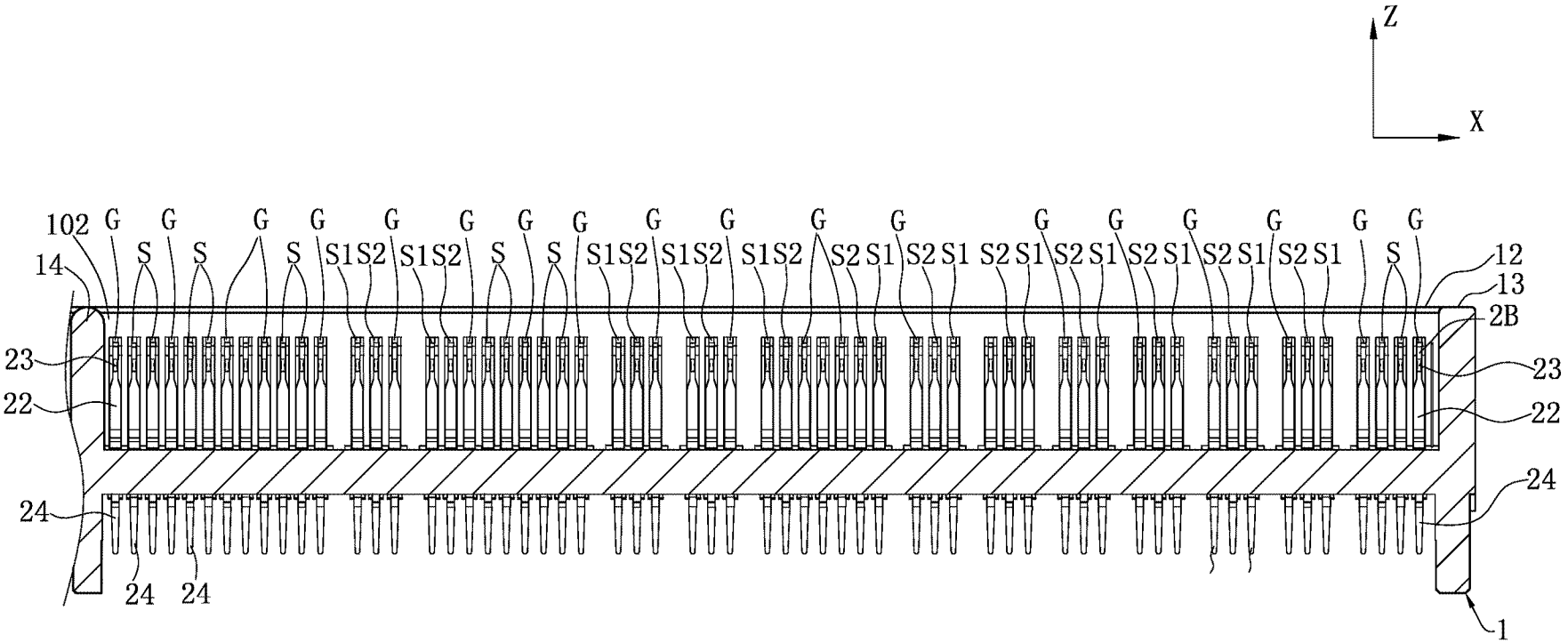
FIG. 6 is a partial sectional view of the electrical connector of FIG. 2 along a line A-A.

FIG. 1, FIG. 2 and FIG. 6 show an electrical connector 100 according to a first embodiment of the present invention. The electrical connector 100 has an insulating body 1 provided in the left-right direction X lengthwise. The insulating body 1 has an insertion slot 10 provided in the left-right direction X lengthwise, configured for insertion of an electronic card 200 in the vertical direction Z. One of the electrical connector 100 and the electronic card 200 is an electrical module, and the other one is an electronic component. A plurality of conductors 2 form a first row and a second row respectively provided at two sides of the insertion slot 10 along the width direction Y. The electronic card 200 has a plurality of pads 201 forming two rows respectively electrically connected with the first row of conductors 2A and the second row of conductors 2B one-to-one correspondingly. Each of the conductors 2 partially extends out of the lower surface of the insulating body 1, and is soldered and fixed to a circuit board 300.

Referring to FIG. 1, FIG. 2 and FIG. 6, the insulating body 1 has a first side wall 11 and a second side wall 12 provided along the left-right direction X lengthwise and opposite to each other along the width direction Y, and two end walls 13 provided opposite to each other along the left-right direction X. The first side wall 11, the second side wall 12 and the two end walls 13 surroundingly form the insertion slot 10. The insulating body 1 further has a fool-proof rib 14. The fool-proof rib 14 is located between the two end walls 13, and is provided in the insertion slot 10 to divide the insertion slot 10 into a long slot 101 and a short slot 102.

Figure 7:
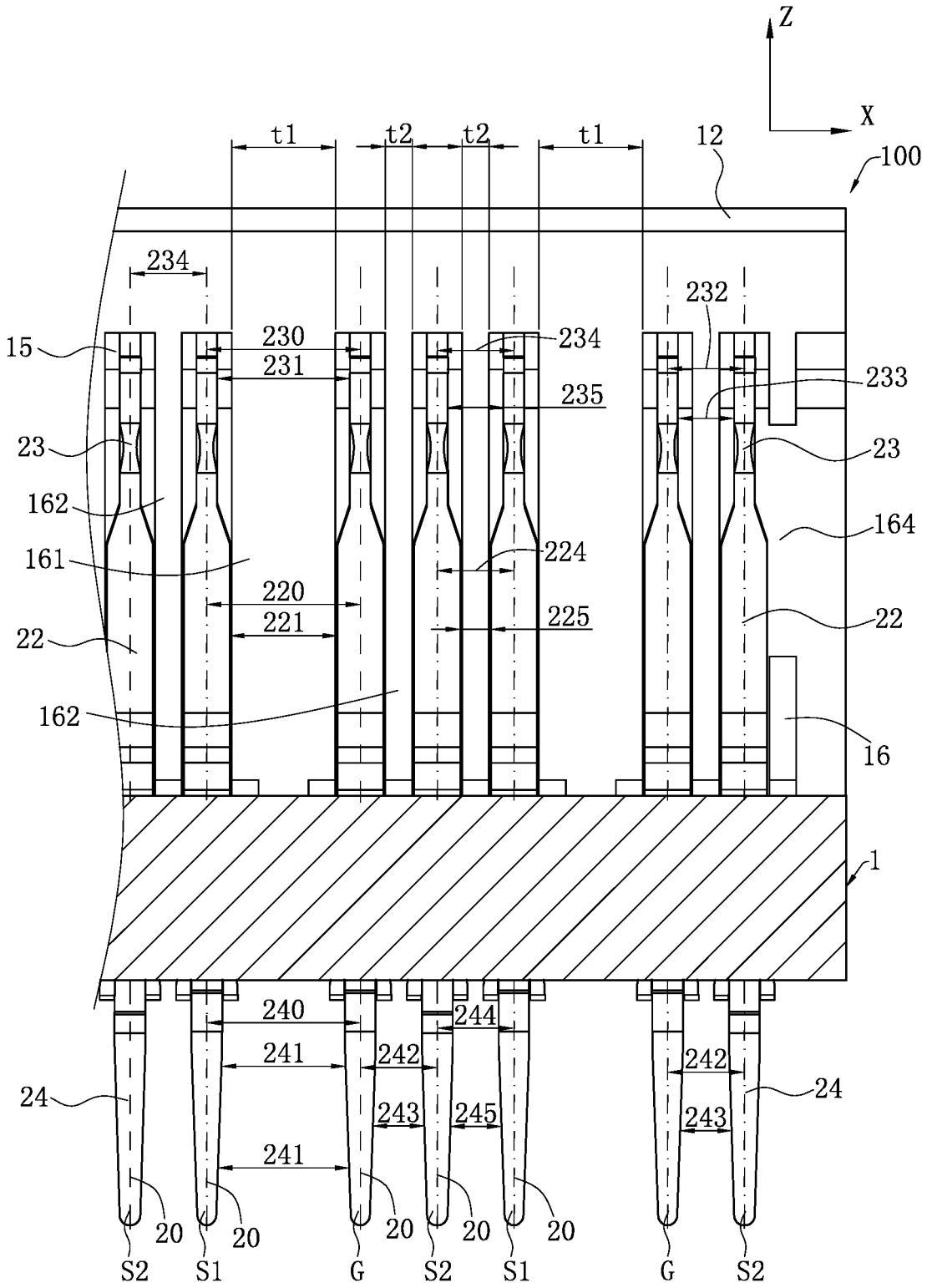
FIG. 7 is a partial plain view of FIG. 6.
Figure 8:
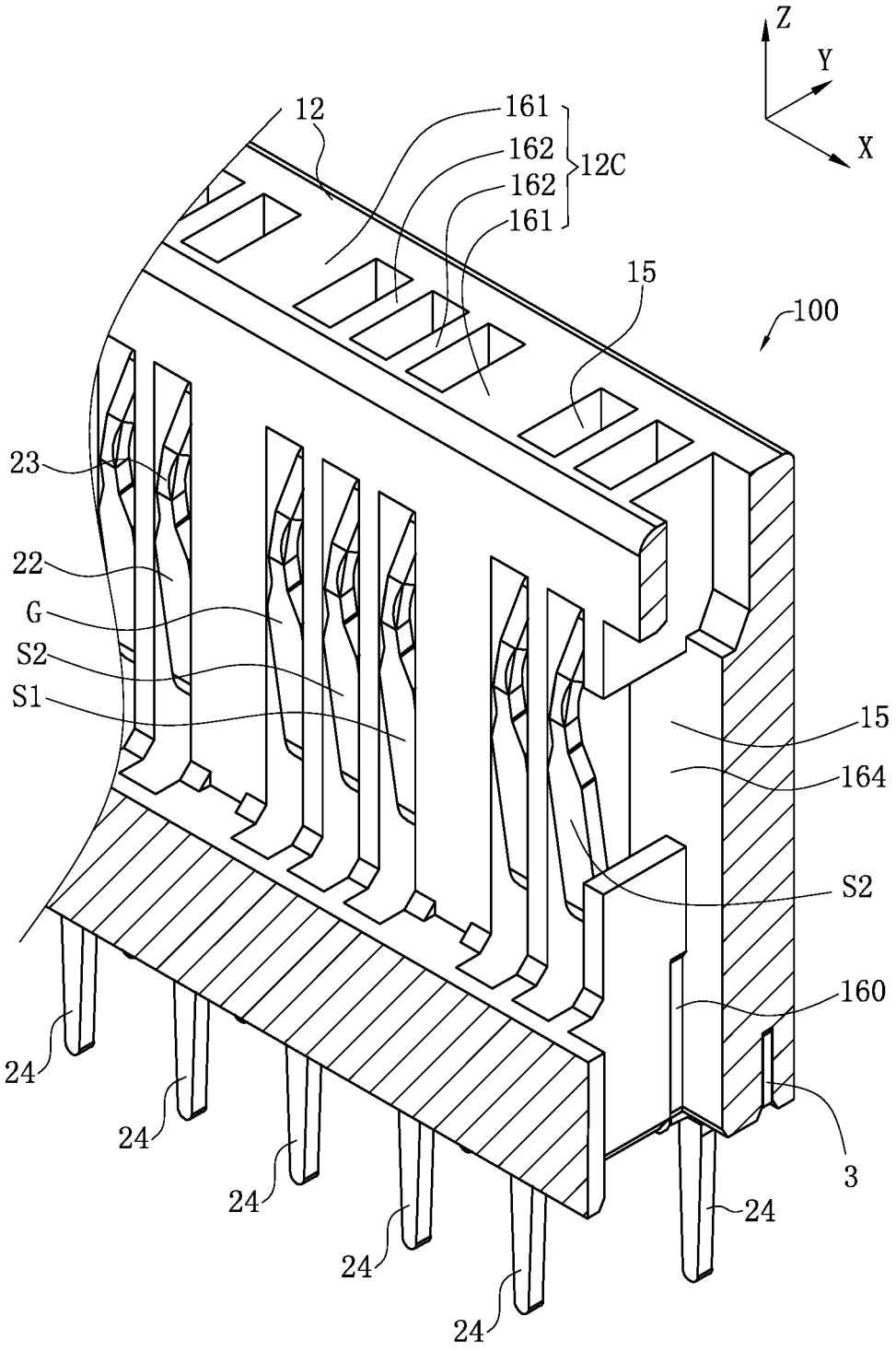
FIG. 8 is a partial perspective view of FIG. 6.

Referring to FIG. 2, FIG. 6 and FIG. 8, each of the first side wall 11 and the second side wall 12 has a plurality of conductor slots 15. The conductor slots 15 of the first side wall 11 are arranged in a row in the left-right direction X, and are used to one-to-one accommodate the first row of conductors 2A. The conductor slots 15 of the second side wall 12 are arranged in a row in the left-right direction X, and are used to one-to-one accommodate the second row of conductors 2B. Referring to FIG. 6, which is a schematic view showing that the second row of conductors 2B are one-to-one accommodated in the conductor slots 15 of the second side wall 12. Each of the conductor slots 15 extends upward from the lower surface of the insulating body 1 to the upper surface of the insulating body 1, and each of the conductor slots 15 partially extends upward and runs through the bottom wall of the insertion slot 10. Each row of conductor slots 15 define a plurality of partition walls 16 in the left-right direction X. One partition wall 16 is defined between each two adjacent conductor slots 15 of one row of conductor slots 15 to partition the two adjacent conductor slots 15 in the left-right direction. Each of the left and right side surfaces of each of the partition walls 16 is downward concavely provided with a fastening slot 160 to fix a corresponding one of the conductor 2. The two fastening slots 160 of each of partition walls 16 are blind holes, and are not in communication with each other. Referring to FIG. 7 and FIG. 8, each row of partition walls 16 include a plurality of first thick walls 161 with uniform thicknesses and a plurality of first thin walls 162 with uniform thicknesses. Each of the first thick walls 161 defines a first thickness t1, and each of the first thin walls 162 defines a second thickness t2. The first thickness t1 is greater than the second thickness t2.

Referring to FIG. 2, FIG. 6 and FIG. 8, the partition walls 16 of the first side wall 11 form a plurality of first combined walls 11C. Each of the first combined walls 11C is formed by two adjacent first thick walls 161 and a pair of first thin walls 162 located between the two adjacent first thick walls 161. The partition walls 16 of the second side wall 12 have a plurality of second combined walls 12C. Each of the second combined walls 12C is formed by two first thick walls 161 and a pair of first thin walls 162 located between the two first thick walls 161. The first combined wall 11C and the second combined wall 12C are respectively provided at two sides of the long slot 101. In the width direction Y, one first thick wall 161 of the first combined wall 11C and the two first thin walls 162 of the second combined wall 12C are provided opposite to each other. The two adjacent first thin walls 162 of the second combined wall 12C define two inner side surfaces opposite to each other and two outer side surfaces opposite to each other in the left-right direction X. The two outer side surfaces opposite to each other are respectively flush with the left and right side surfaces of the first thick walls 161 of a corresponding first combined wall 11C in the width direction Y, and one first thick wall 161 of the first combined wall 11C and the two first thick walls 161 of the opposite second combined wall 12C are staggered to form an isosceles triangle M. On the contrary, in the width direction Y, one first thick wall 161 of the second combined wall 12C and the two first thin walls 162 of the corresponding first combined wall 11C are provided opposite to each other in the left-right direction. The two outer side surfaces of the two first thin walls 162 are flush with the two side surfaces of the one first thick wall 161. One first thick wall 161 of the second combined wall 12C and the two first thick walls 161 of the two opposite first combined walls 11C form an isosceles triangle M. The first thick wall 161 of the first combined wall 11C directly face the two first thin walls 162 of the second combined wall 12C, such that the conductor slot 15 between the two first thin walls 162 of the second combined wall 12C is opposite to the partition wall 16 of the first combined wall 11C, and one side of the bottom wall of the insertion slot 10 is run through, while the other side is not run through. Compared with the case where the two sides of the bottom wall of the insertion slot 10 are run through by the conductor slots 15 one-to-one opposite to each other, the bottom wall of the insertion slot 10 in the present embodiment has a higher strength, which is conductive to the intensity of the insulating body 1.

Figure 3:
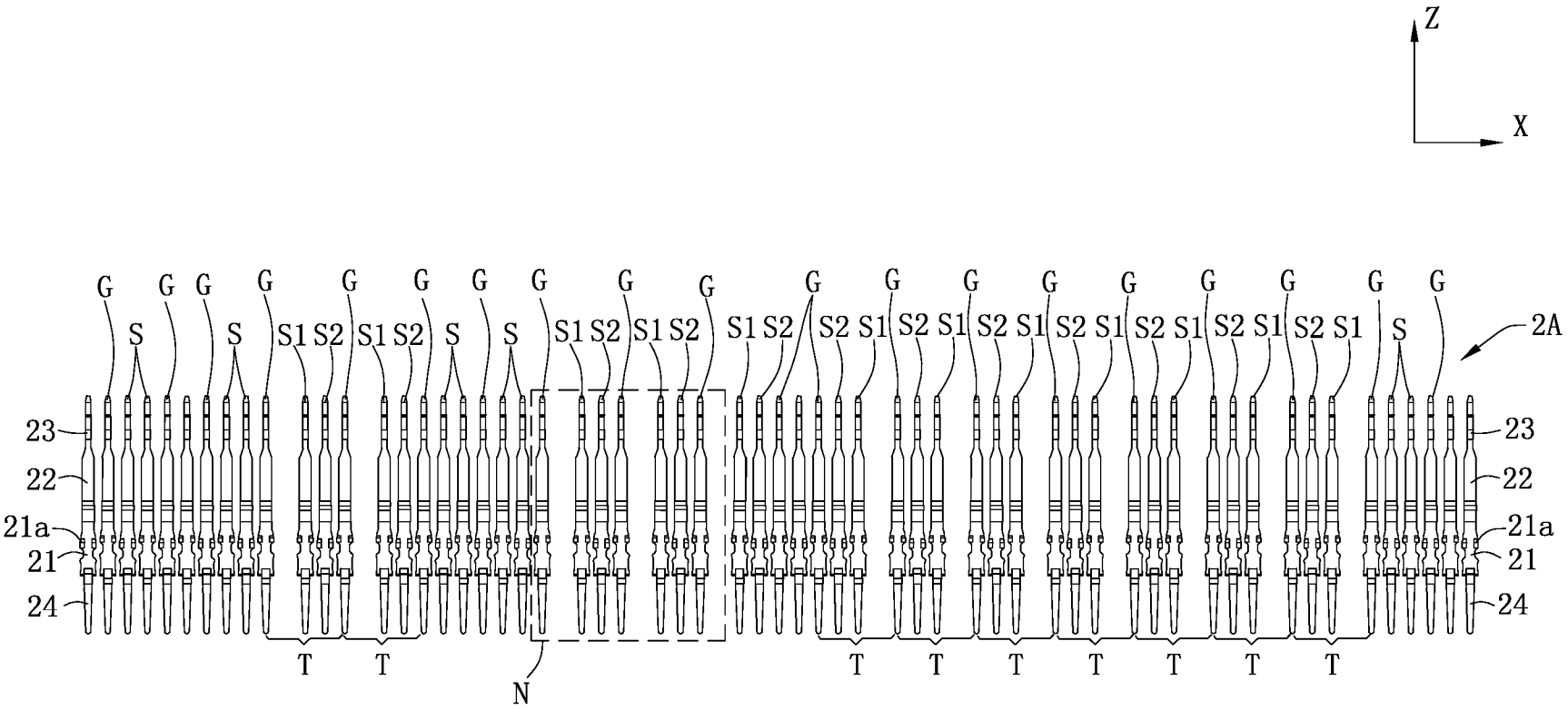
FIG. 3 is a plain view of a first row of conductors of the electrical connector according to the first embodiment of the present invention viewing along a width direction.
Figure 4:
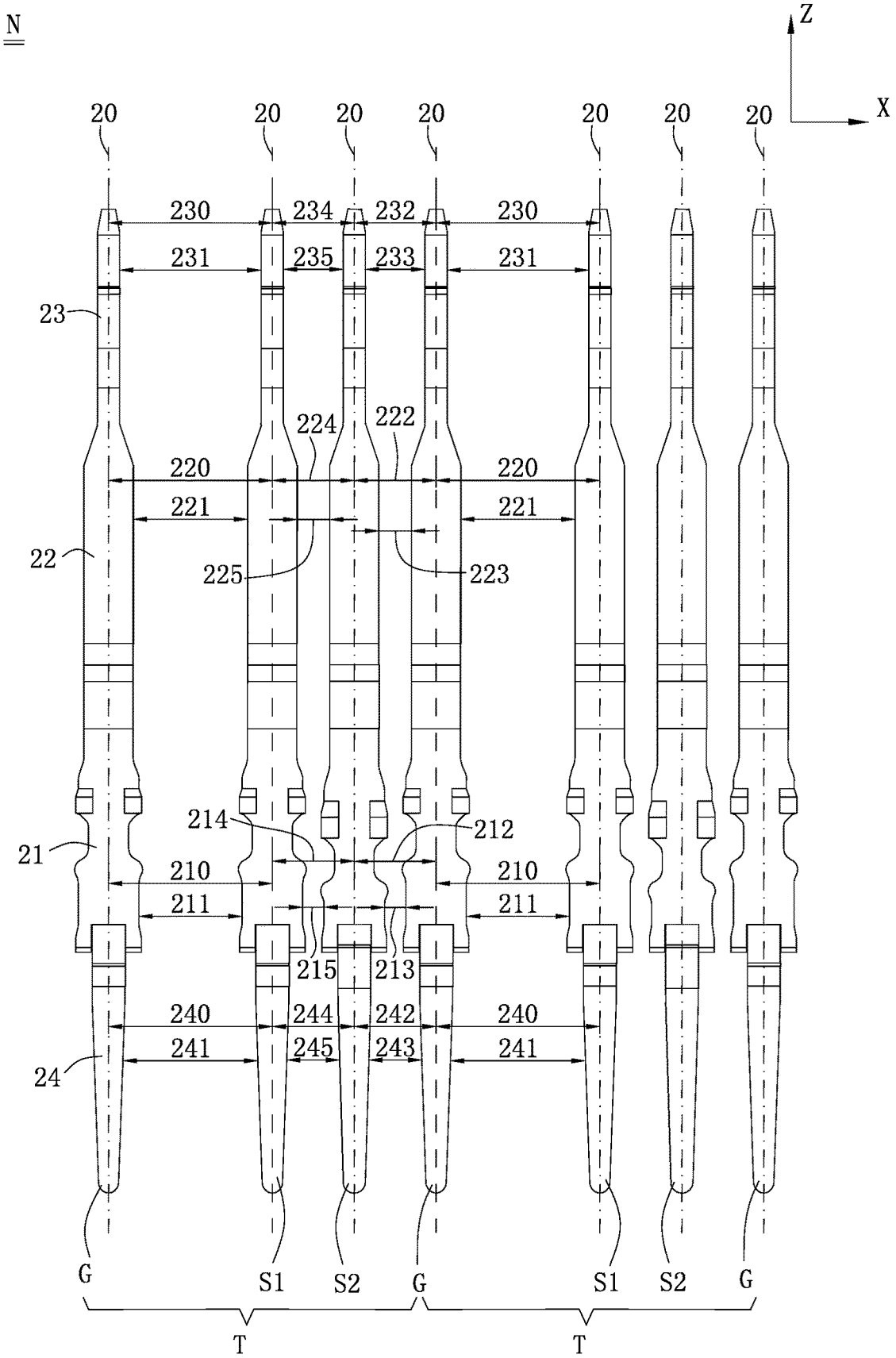
FIG. 4 is a partial plain view of the first row of conductors of FIG. 3.

Referring to FIG. 1, FIG. 3 and FIG. 4, each conductor 2 of the first row of conductors 2A and the second row of conductors 2B has a fixing portion 21 vertically extending in the vertical direction Z. Each of the left and right sides of each of the fixing portions 21 is provided with a barb 21*a*. A connecting portion 22 extends upward from the fixing portion 21. A contact portion 23 extends upward from the connecting portion 22 and protrudes into the insertion slot 10. A tail portion 24 extends downward from the fixing portion 21 to be soldered and fixed to the circuit board 300. Each of the conductors 2 defines a virtual center line 20 along its extending path. The virtual center line 20 extends from the contact portion 23 to the tail portion 24, and is not deviated in the left-right direction X. Each of the conductors 2 is provided symmetrically about the virtual center line 20 in the left-right direction. A distance between the virtual center lines 20 of each two adjacent conductors 2 in each row of conductors 2 in the left-right direction X is defined as a center distance. A distance between the left and right opposite inner edges of each two adjacent conductors 2 in each row of conductors 2 is defined as an interval. Each row of conductors 2 may achieve a desired high-frequency performance by adjusting the sizes of the center distances and the size of the intervals.

Referring to FIG. 7 and FIG. 8, the barbs 21*a* of each of fixing portions 21 of the first row of conductors 2A are used to fix the corresponding conductor 2 to the fastening slots 160 of the corresponding conductor slot 15. All the fixing portions 21 in the first row of conductors 2A are provided in a row on the first side wall 11 in the left-right direction X. Each of the connecting portions 22 of the first row of conductors 2A is accommodated in the corresponding conductor slot 15, and is suspended relative to the inner wall of the corresponding conductor slot 15. All the connecting portions 22 in the first row of conductors 2A are provided in a row in the left-right direction X. Each contact portion 23 of the first row of conductors 2A protrudes from the first side wall 11 into the insertion slot 10, so as to be electrically connected with the corresponding pad 201.

Referring to FIG. 7 and FIG. 8, the barbs 21*a* of each of the fixing portions 21 of the second row of conductors 2B are used to fix the corresponding conductor 2 to the corresponding conductor slot 15. All the fixing portions 21 in the second row of conductors 2B are provided in a row on the second side wall 12 in the left-right direction X. Each of the connecting portions 22 of the second row of conductors 2B is accommodated in the corresponding conductor slot 15, and is suspended relative to the inner wall of the corresponding conductor slot 15. All the connecting portions 22 in the first row of conductors 2A are provided in a row in the left-right direction X. Each of the contact portions 23 of the second row of conductors 2B protrudes from the second side wall 12 into the insertion slot 10, so as to be electrically connected with the corresponding pad 201.

Figure 5:
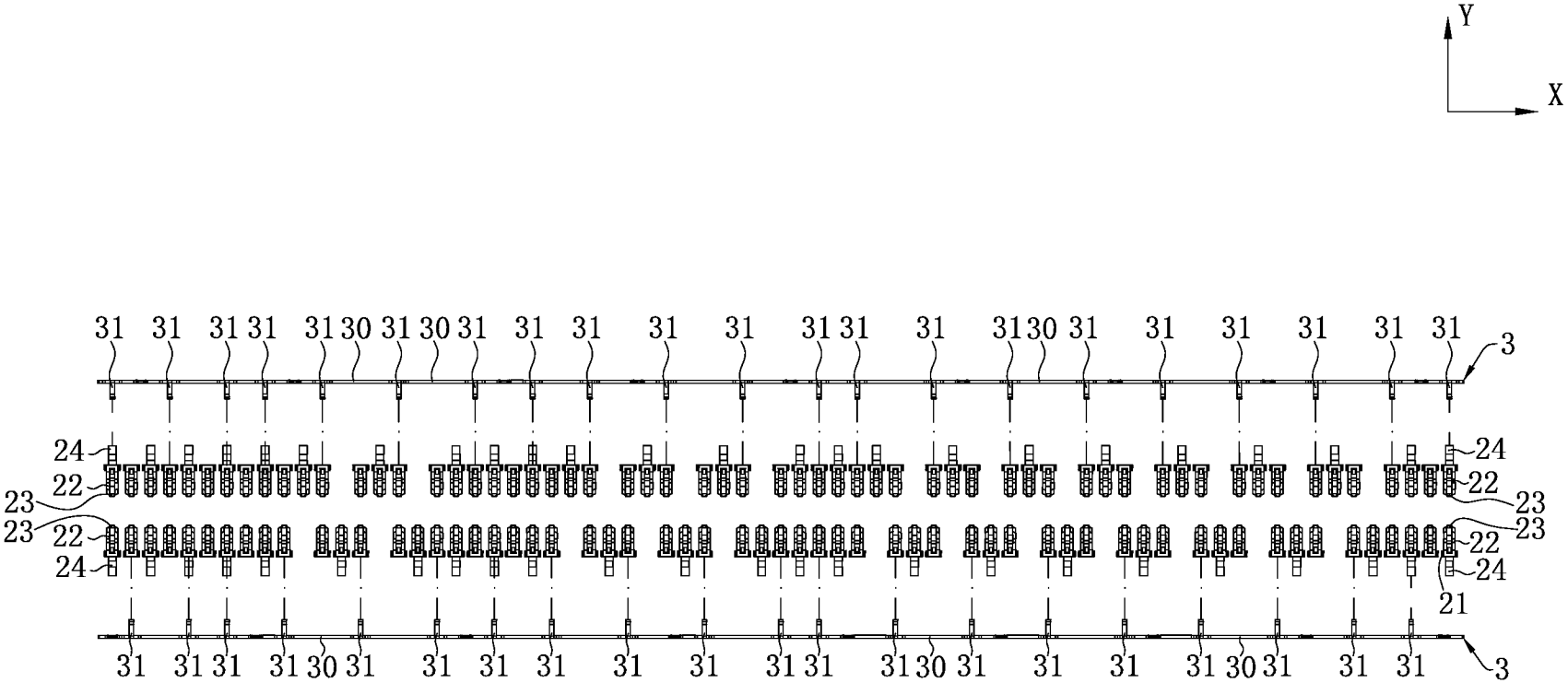
FIG. 5 is a plain view of the first row of conductors and a second row of conductors of the electrical connector according to the first embodiment of the present invention viewing downward from top thereof.
Figure 9:
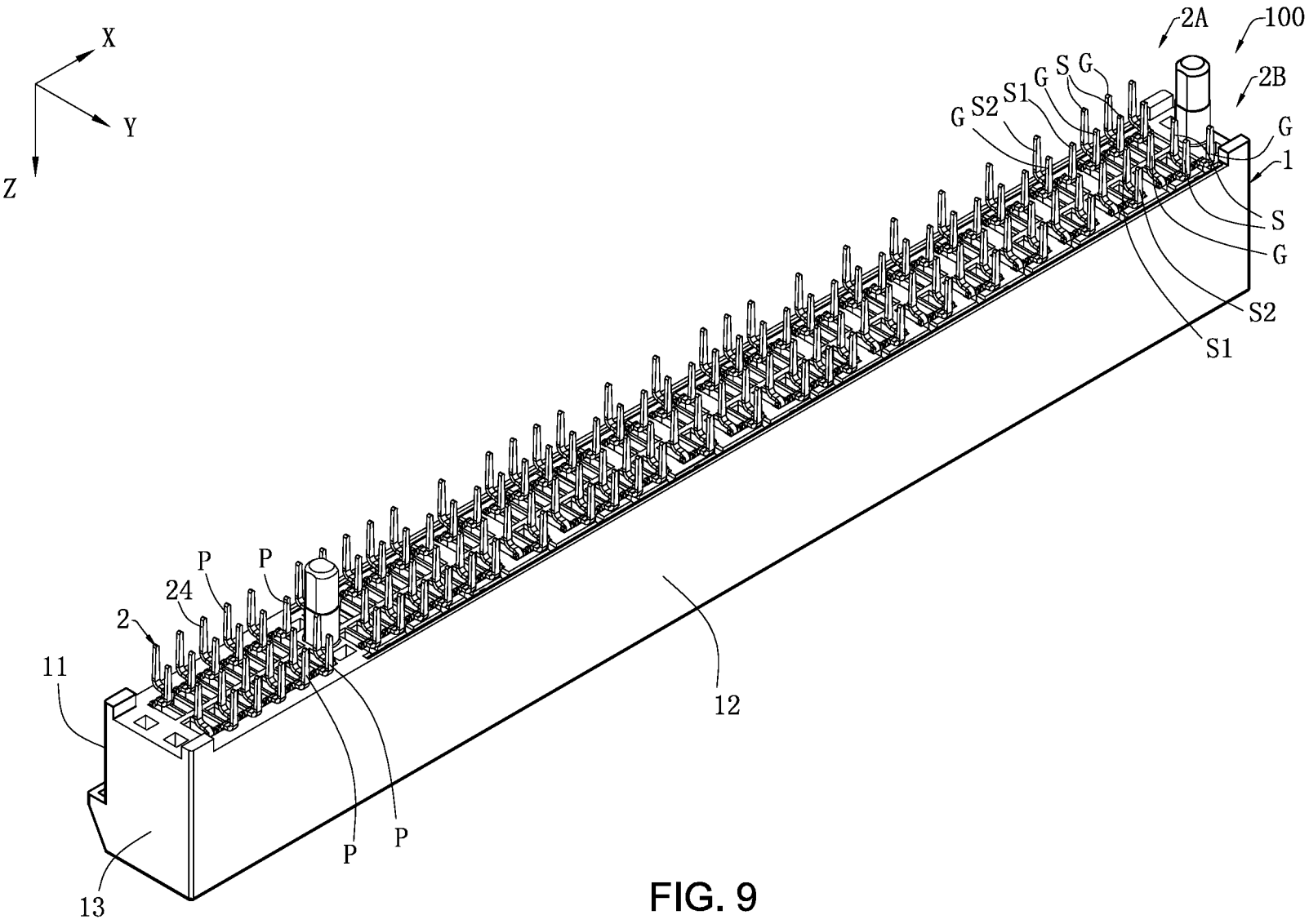
FIG. 9 is a perspective assembled view of the electrical connector according to the first embodiment of the present invention in another viewing angle.

Referring to FIG. 5 and FIG. 9, all the tail portions 24 of each row of conductors 2 are arranged in two rows. The two rows of tail portions 24 of each row of conductors 2 are arranged in the left-right direction X, and the two rows of tail portions 24 are arranged in parallel at intervals in the width direction Y. A direction relatively close to the insertion slot 10 in the width direction Y is defined as an inner side, and a direction relatively away from the insertion slot 10 in the width direction Y is defined as an outer side. In each row of conductors 2, the two rows of tail portions 24 are respectively located at the inner and outer sides of one row of fixing portions 21.

Referring to FIG. 1, FIG. 3, FIG. 5 and FIG. 9, each row of the first row of conductors 2A and the second row of conductors 2B has a plurality of power conductors P, a plurality of ground conductors G and a plurality of signal conductors S. The power conductors P are provided on the first side wall 11 and the second side wall 12 of the short slot 102. The ground conductors G and the signal conductors S are provided on the first side wall 11 and the second side wall 12 of the long slot 101.

Referring to FIG. 3, FIG. 5 and FIG. 6, the signal conductors S are provided in pairs, and each pair of the signal conductors S transmits a high-frequency signal. In the present embodiment, the high-frequency signals being transmitted are differential signals. In each row of conductors 2, the ground conductors G and the pairs of signal conductors S are alternately arranged in the left-right direction X. That is, each of the left and right adjacent sides of each pair of signal conductors S is provided with a ground conductor G.

Referring to FIG. 3, FIG. 4 and FIG. 5, the ground conductors G and the pairs of signal conductors S in each row of conductors 2 form a plurality of conductive units T. Each of the conductive units T is formed by one pair of signal conductors S and two ground conductors G located at the two adjacent sides of the pair of signal conductors S. The pair of signal conductors S of each of the conductive units T include a first signal conductor S1 and a second signal conductor S2. In each of the conductive units T, the center distances and the intervals from the pair of signal conductors S to the ground conductors G at the two adjacent sides are not equal, respectively. In each of the conductive units T, a distance from the virtual center line 20 of the first signal conductor S1 to the virtual center line 20 of its adjacent ground conductor G is uniformly set along the extending path of the conductors 2. That is, in the first signal conductor S1 and its adjacent ground conductor G, a distance between the virtual center lines 20 of the two adjacent contact portions 23 in the left-right direction X is defined as a first contact center distance 230, a distance between the virtual center lines 20 of two adjacent connecting portions 22 in the left-right direction X is defined as a first connecting center distance 220, a distance between the virtual center lines 20 of two adjacent fixing portions 21 in the left-right direction X is defined as a first fixing center distance 210, and a distance between the virtual center lines 20 of two adjacent tail portions 24 in the left-right direction X is defined as a first tail portion center distance 240. Along the extending path of the conductors 2, the first contact center distance 230, the first connecting center distance 220, the first fixing center distance 210 and the first tail portion center distance 240 are equal, such that the impedance of the first signal conductor S1 is maintained balanced, and the interfering electromagnetic waves of the ground conductor G adjacent to the first signal conductor S1 to the first signal conductor S1 on its extending path is uniform, thereby avoiding from sharp points of the interfering electromagnetic waves and facilitating stable transmission of signals, which is conductive to the high-frequency performance. Meanwhile, in each of the conductive units T, in the first signal conductor S1 and its adjacent ground conductor G, an interval between the two contact portions 23 is defined as a first contact interval 231, an interval between the two connecting portions 22 is defined as a first connecting interval 221, an interval between the two fixing portions 21 is defined as a first fixing interval 211, and an interval between the two tail portions 24 is defined as a first tail interval 241. Along the extending path of the conductors 2, the first contact interval 231 is uniformly set, and the first connecting interval 221 is uniformly set, such that the capacity coupling occurring between the first signal conductor S1 and its adjacent ground conductor G is stable, and the ground interfering electromagnetic waves of the ground conductor G adjacent to the first signal conductor S1 on its extending path are more uniform, thereby avoiding from sharp points of the interfering electromagnetic waves and further facilitating stable transmission of the signals, which is conductive to the high-frequency performance.

Referring to FIG. 3, FIG. 4 and FIG. 5, in each of the conductive units T, the center distance between the second signal conductor S2 and the adjacent ground conductor G is uniformly set. That is, in the second signal conductor S2 and its adjacent ground conductor G, a center distance between two adjacent contact portions 23 is defined as a second contact center distance 232, a center distance between two adjacent connecting portions 22 is defined as a second connecting center distance 222, a center distance between two adjacent fixing portions 21 is defined as a second fixing center distance 212, and a center distance between two adjacent tail portions 24 is defined as a second tail portion center distance 242. Along the extending path of the conductors 2, the second contact center distance 232, the second connecting center distance 222, the second fixing center distance 212 and the second tail portion center distance 242 are equal, such that the impedance of the second signal conductor S2 is maintained balanced, and the ground interfering electromagnetic waves of the ground conductor G adjacent to the second signal conductor S2 on its extending path is uniform, thereby avoiding from sharp points of the interfering electromagnetic waves and facilitating the stable transmission of signals. Meanwhile, in each of the conductive units T, in the second signal conductor S2 and its adjacent ground conductor G, an interval between the two contact portions 23 is defined as a second contact interval 233, an interval between the two connecting portions 22 is defined as a second connecting interval 223, an interval between the two fixing portions 21 is defined as a second fixing interval 213, and an interval between the two tail portions 24 is defined as a second tail interval 243. Along the extending path of the conductors 2, the second contact interval 233 is uniformly set, and the second connecting spacing 223 is uniformly set, such that the capacity coupling occurring between the other second signal conductor S2 and its adjacent first ground conductor G is stable, and the ground interfering electromagnetic waves of the ground conductor G adjacent to the second signal conductor S2 on its extending path are more uniform, thereby avoiding from sharp points of the interfering electromagnetic waves and further facilitating stable transmission of the signals, which is conductive to the high-frequency performance.

Referring to FIG. 3, FIG. 4 and FIG. 5, the center distance between each pair of signal conductors S is uniformly set along the extending path of the conductors 2. That is, in each pair of signal conductors S, the center distance between the two contact portions 23 is defined as a third contact center distance 234, the center distance between the two connecting portions 22 is defined as a third connecting center distance 224, the center distance between the two fixing portions 21 is defined as a third fixing center distance 214, and the center distance between the two tail portions 24 is defined as a third tail portion center distance 244. Along the extending path of the conductors 2, the third contact center distance 234, the third connecting center distance 224, the third fixing center distance 214 and the third tail portion center distance 244 are equal. Each pair of signal conductors S transmit the differential signals. The differential signals are transmitted in the form of a differential mode. The center distance between the first signal conductor S1 and the second signal conductor S2 is equal on the extending path of the conductors 2, which is conductive to the differential mode transmission of the differential signal, and further improves the anti-crosstalk interference property of the first signal conductor S1 and the second signal conductor S2. In each pair of signal conductors S, the interval between the two contact portions 23 is defined as a third contact interval 235, the interval between the two connecting portions 22 is defined as a third connecting interval 225, the interval between the two fixing portions 21 is defined as a third fixing interval 215, and the interval between the two tail portions 24 is defined as a fourth tail interval 245. Along the extending path of the conductors 2, the third contact interval 235 is uniformly set, and the third connecting spacing 225 is uniformly set, such that the signal coupling between the pair of signal conductors S is more stable, which is conductive to the stable transmission of the high-frequency signals.

Referring to FIG. 3, FIG. 4 and FIG. 5, the conductive units T of each row of conductors 2 are continuously sequentially arranged in the left-right direction X. Any two continuously arranged conductive units T share one ground conductor G, reducing the quantity of the ground conductors G, and thereby reducing the influence of the ground resonance on the signal transmission. In each two continuously adjacent conductive units T, one of the signal conductors at two adjacent sides of the shared ground conductor G is the first signal conductor S1, and the first contact center distance 230, the first contact interval 231, the first connecting center distance 220, the first connecting interval 221, the first fixing center distance 210, the first fixing interval 211, the first tail portion center distance 240 and the first tail interval 241 are all formed between the first signal conductor S1 and the shared ground conductor G. The other one of the signal conductors at the two adjacent sides of the shared ground conductor G is the second signal conductor S2, and the second contact center distance 232, the second contact interval 233, the second connecting center distance 222, the second connecting interval 223, the second fixing center distance 212, the second fixing interval 213, the second tail portion center distance 242 and the second tail interval 243 are all formed between the second signal conductor S2 and the shared ground conductor G.

Referring to FIG. 3, FIG. 4 and FIG. 5, before and after the electronic card 200 is inserted into the insertion slot 10, the first contact center distance 230 is greater than the second contact center distance 232 and the third contact center distance 234, the second contact center distance 232 is equal to the third contact center distance 234, the first contact interval 231 is greater than the second contact interval 233 and the second contact center distance 232, and the second contact interval 233 is equal to the third contact interval 235. The high-frequency signal of the electronic card 200 is transmitted to the conductors 2 through the contact portions 23. Insertion loss may be generated in the process of transmitting the high-frequency signal of the electronic card 200 to the conductors 2. The resonance of the ground conductors G is a factor that affects the insertion loss. Compared with the related art where a row of terminals are provided at equal center distances and equal intervals, in the electrical connector 100 of the present embodiment, the first contact center distance 230 is greater than the second contact center distance 232 and the third contact center distance 234, and the first contact interval 231 is greater than the second contact interval 233 and the third contact interval 235, such that in each of the conductive units T, an average contact center distance and an average contact interval from the two ground conductors G to the pair of signal conductors S are increased, thereby reducing the resonance to the first signal conductor S1 from the adjacent ground conductor G. Meanwhile, the second contact center distance 232 is equal to the third contact center distance 234, and the second contact interval 233 is equal to the third contact interval 235, such that the center distance between the two ground conductors G of each of the conductive units T is further increased, thereby reducing the overlapping of the interfering electromagnetic waves of the two ground conductors G of each of the conductive units T, and reducing the ground resonance. Compared with the related art, in the present embodiment, the first contact interval 231 is greater than the second contact interval 233 and the third contact interval 235, and the second contact interval 233 is equal to the third contact interval 235, such that the impedance of each pair of signal conductors S is reduced. Thus, when the high-frequency signal is transmitted from the electronic card 200 to the conductors 2, the energy of the high-frequency signal is more easily transmitted through the pair of signal conductors S, thereby reducing the insertion loss, and facilitating the high-frequency performance. Meanwhile, more energy of the high-frequency signal is transmitted through the pair of signal conductors S. The pair of signal conductors S for transmitting a differential signal has anti-crosstalk characteristics. By having more energy to be transmitted through the pair of signal conductors S, the anti-crosstalk effect of the electrical connector 100 is better.

Figure 10:
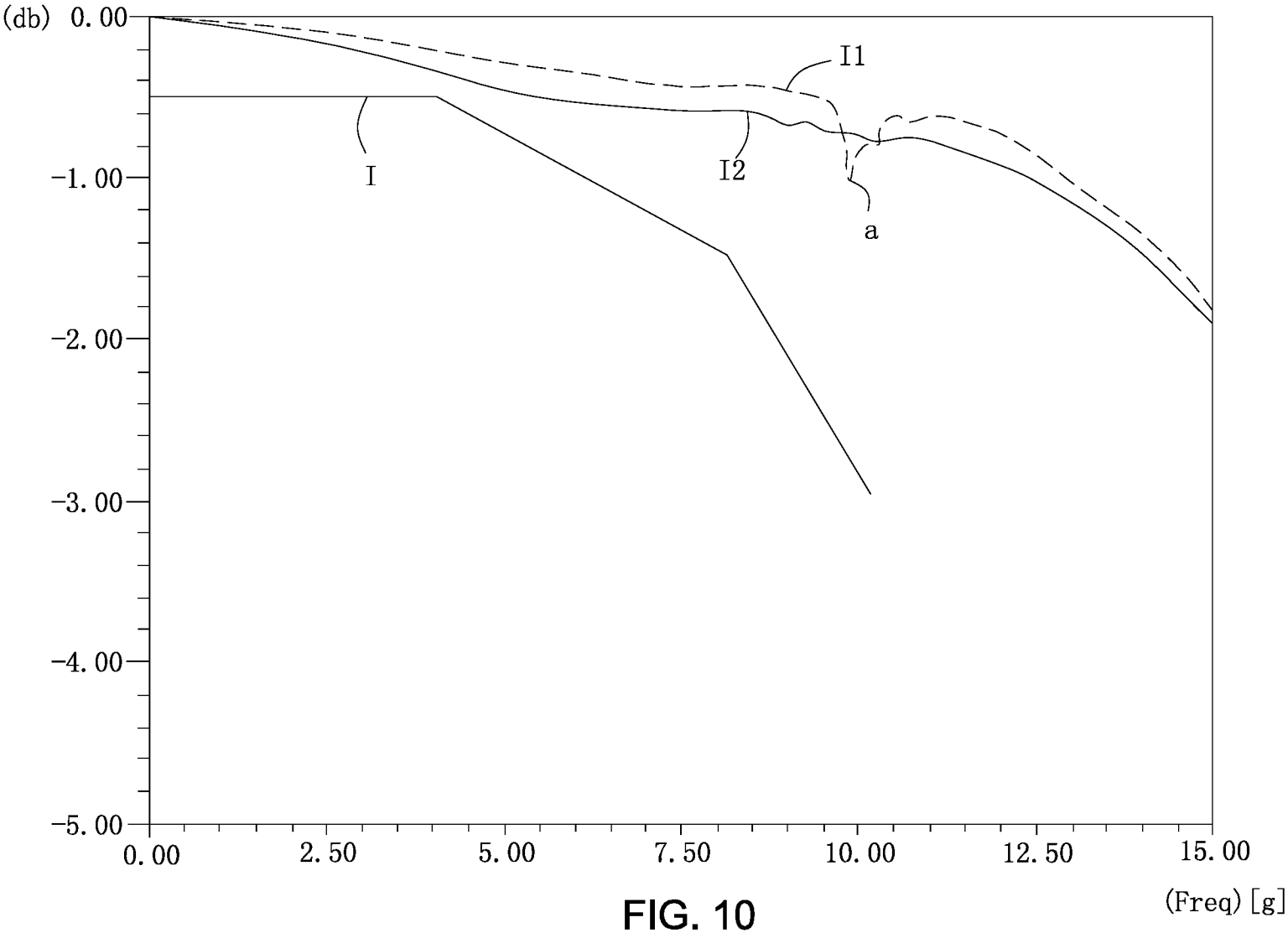
FIG. 10 is a comparison curve chart of insertion loss of the electrical connector according to the first embodiment of the present invention and insertion loss of the electrical connector in the related art.
Figure 12:
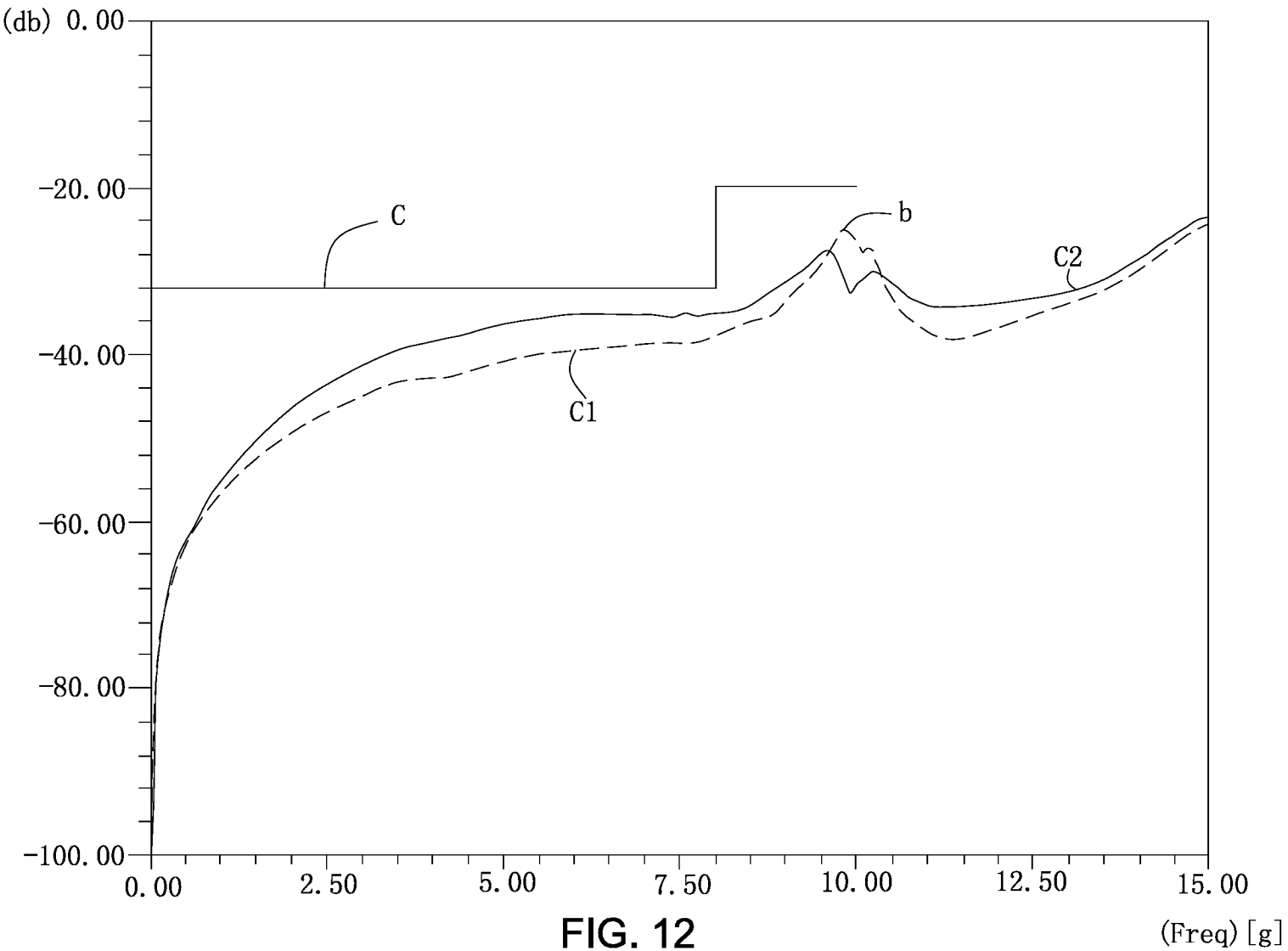
FIG. 12 is a comparison curve chart of a near-end crosstalk curve of the electrical connector according to the first embodiment of the present invention and a near-end crosstalk curve of the electrical connector in the related art.

FIG. 10 shows a comparison curve chart of insertion loss of the electrical connector in the related art and insertion loss of the electrical connector 100 of the present embodiment, where I is a standard line of the insertion loss of the general specification in the art, and I1 is an insertion loss curve in the related art. There is a resonance point a in the curve I1. I2 is an insertion loss curve of the electrical connector 100 of the present embodiment. It can be seen from FIG. 10 that I2 has a steadier curve trend, eliminating the resonance point a of the curve I1. The curve I2 has the curve trend closer to that of the standard line I, such that the electrical connector 100 may achieve the desired high-frequency performance. FIG. 12 shows a comparison curve chart of near-end crosstalk of the electrical connector in the prior art and near-end crosstalk of the electrical connector 100 of the present embodiment, where C is a standard line of crosstalk of the general specification in the art, C1 is a near-end crosstalk curve of the electrical connector in the related art, and C2 is a near-end crosstalk curve of the electrical connector 100 of the present embodiment. It can be seen from FIG. 12 that the curve C2 is closer to the standard line C, eliminating a resonance point b of the curve C1, such that the electrical connector 100 of the present embodiment has a better anti-crosstalk effect than the electrical connector in the related art.

Figure 11:
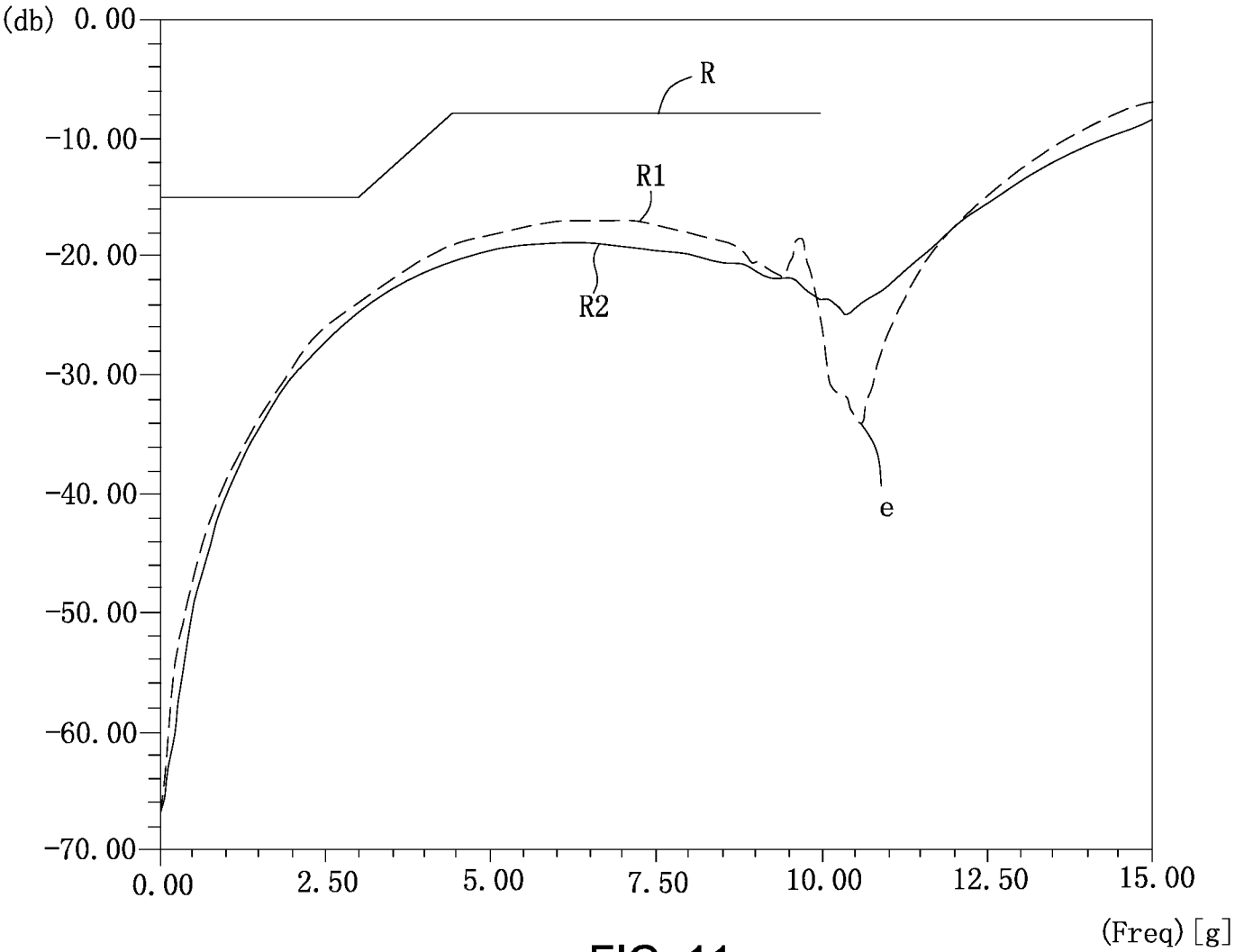
FIG. 11 is a comparison curve chart of return loss of the electrical connector according to the first embodiment of the present invention and return loss of the electrical connector in the related art.

Referring to FIG. 3, FIG. 4 and FIG. 5, the connecting portions 22 and the fixing portions 21 are intermediate paths for transmitting signals in the conductors 2. The ideal high-frequency characteristics may be achieved by adjusting the center distances and the intervals between the various connecting portions 22 and the various fixing portions 21. Thus, in the present embodiment, the first connecting center distance 220 is greater than the second connecting center distance 222 and the third connecting center distance 224, the second connecting center distance 222 is equal to the third connecting center distance 224, the first connecting interval 221 is greater than the second connecting interval 223, the second connecting interval 223 is equal to the third connecting interval 225, the first fixing center distance 210 is greater than the second fixing center distance 212, the second fixing center distance 212 is equal to the third fixing center distance 214, the first fixing interval 211 is greater than the second fixing interval 213, and the second fixing interval 213 is equal to the third fixing interval 215. Therefore, in each of the conductive units T, an average center distance and an average interval from the transmission intermediate paths of the pair of ground conductors G to the transmission intermediate paths of the pair of signal conductors S are increased, which reduces return loss of the pair of signal conductors S and is conductive to the attenuation of the high-frequency signal on the transmission path of the conductors 2. Referring to FIG. 11, R is a standard line of the return loss of the general specification in the art, R1 is a return loss curve of the electrical connector in the related art, and R2 is a return loss curve of the electrical connector 100 of the present embodiment. Compared with the curve R1 in the related art, the curve graph R2 of the present embodiment is closer to the standard line R, and significantly eliminates a resonance point e on the curve R1, such that the return loss characteristics of the electrical connector 100 of the present embodiment is better.

Figure 13:
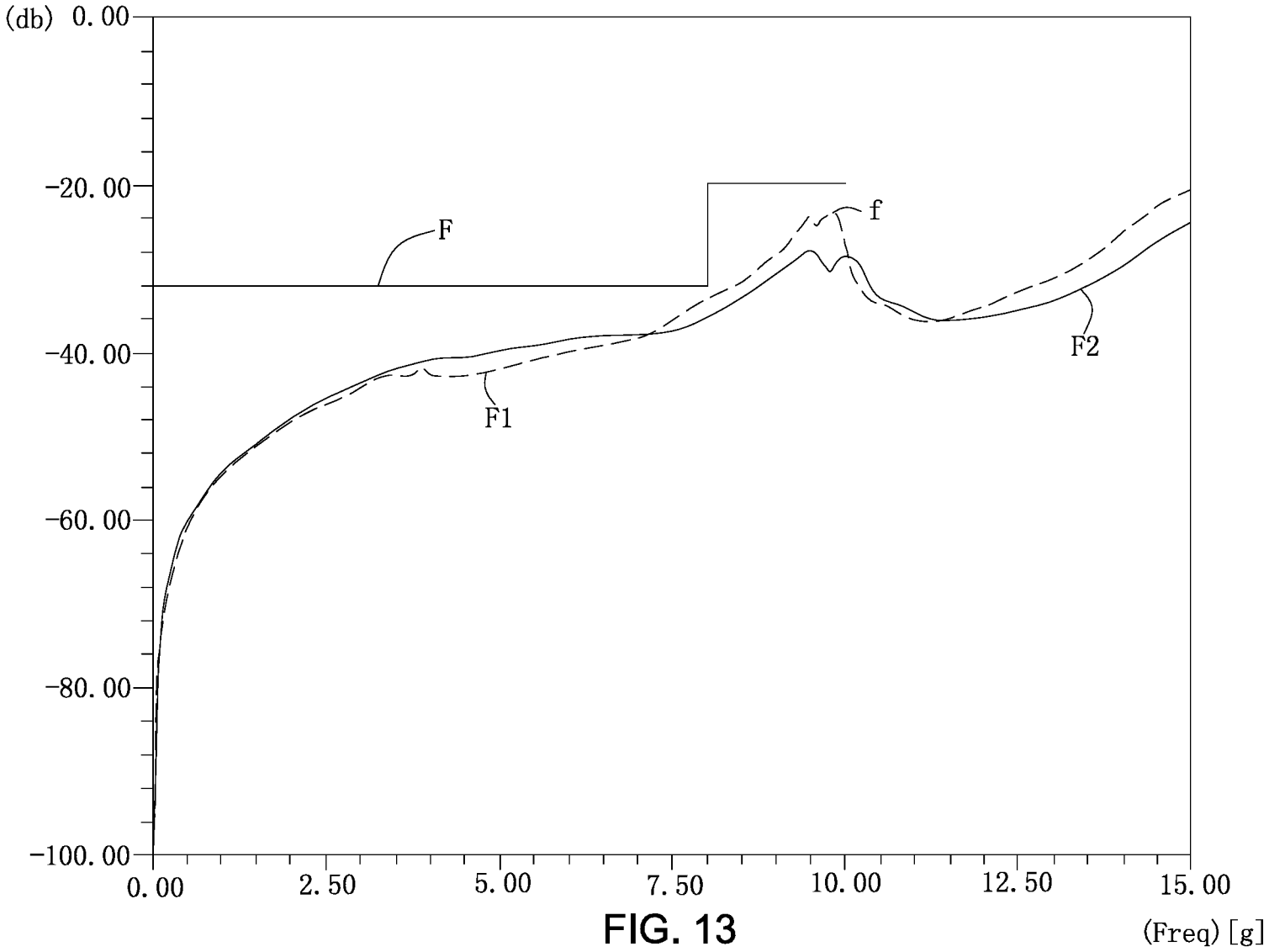
FIG. 13 is a comparison curve chart of a far-end crosstalk curve of the electrical connector according to the first embodiment of the present invention and a far-end crosstalk curve of the electrical connector in the related art.

Referring to FIG. 3, FIG. 4 and FIG. 5, the tail portions 24 are soldered and fixed to the circuit board 300, such that the high-frequency signals transmitted to the trail portions 24 are circulated to the circuit board 300, thereby realizing the high-frequency signals being input through the contact portions 23 and output through the tail portions 24. In the present embodiment, the first fixing center distance 210 is greater than the second fixing center distance 212 and the third fixing center distance 214, the second fixing center distance 212 is equal to the third fixing center distance 214, the first fixing interval 211 is greater than the second fixing interval 213 and the third fixing interval 215, and the second fixing interval 213 is equal to the third fixing interval 215. Compared with the related art, in the electrical connector 100 of the present embodiment, by increasing the average tail portion center distances and the average tail intervals from the fixing portions 21 of the two ground conductors G of each of the conductive units T to the fixing portions 21 of the pair of signal conductors S, the electrical connector 100 has a good anti-crosstalk effect at the high-frequency signal output position. FIG. 13 shows a comparison curve chart of the far-end crosstalk, where F is a standard line of the crosstalk of the general specification in the art, F1 is a far-end crosstalk curve in the related art, and F2 is a far-end crosstalk curve of the electrical connector 100 of the present embodiment. It can be seen from FIG. 13 that the curve F2 of the electrical connector 100 of the present embodiment eliminates a resonance point fin the curve F1 of the electrical connector in the related art, such that the electrical connector 100 of the present embodiment has better high-frequency characteristics.

Referring to FIG. 7 and FIG. 8, the first row of conductors 2A are inserted into the first side wall 11 upward from bottom thereof. Each conductor 2 of the first row of conductors 2A is correspondingly accommodated in a conductor slot 15. Each conductive unit T of the first row of conductors 2A corresponds to a first combined wall 11C. The second row of conductors 2B are inserted into the second side wall 12 upward from bottom thereof. Each conductor 2 of the second row of conductors 2B is correspondingly accommodated in a conductor slot 15. Each conductive unit T of the second row of conductors 2B corresponds to a second combined wall 12C. Further, in each conductive unit T, a first thick wall 161 is provided between the first signal conductor S1 and its adjacent ground conductor G, and a first average dielectric coefficient ε1 is defined between the first signal conductor S1 and the adjacent ground conductor G. A first thin wall 162 is provided between the second signal conductor S2 and its adjacent ground conductor G, and a second average dielectric coefficient ε2 is defined between the second signal conductor S2 and its adjacent ground conductor G. A first thin wall 162 is provided between the first signal conductor S1 and the second signal conductor S2, and a third average dielectric coefficient ε3 is defined between the pair of signal conductors S. The thickness of the first thick wall 161 is greater than the thickness of the first thin wall 162, such that the first average dielectric coefficient ε1 is greater than the second average dielectric coefficient ε2. Since the average center distances and the average intervals between the first signal conductor S1 and the adjacent ground conductor G are all greater than the average center distances and the average intervals between the second signal conductor S2 and the adjacent ground conductor G, the first average dielectric coefficient ci is greater than the second average dielectric coefficient ε2, thus balancing the capacitance between the pair of signal conductors S and between the ground conductors G at the two sides, and facilitating the coupling of the high-frequency signals between the pair of signal conductors S. Each first thin wall 162 is uniform and equal in thickness, such that the second average dielectric coefficient ε2 is equal to the third average dielectric coefficient ε3, thus adjusting the impedance of the pair of signal conductors S.

In order to promote the coupling of the high-frequency signals between the pair of signal conductors S, the first thin wall 162 between the first signal conductor S1 and the second signal conductor S2 is provided with a window 164, such that the two connecting portions 22 of the pair of signal conductors S are in air communication, and the third average dielectric coefficient ε3 is reduced. Each first thin wall 162 is provided with the two fastening slots 160 located below the window 164 to fix the fixing portions 21. The two fastening slots 160 are blind holes, such that the two fixing portions 21 are not in communication in the left-right direction, which is conductive to the intensity of the insulating body 1, and also conductive to the adjustment of the impedance of the pair of signal conductors S.

Referring to FIG. 5, in the width direction Y, each first signal conductor S1 of each row of conductors 2 is opposite to a ground conductor G of the other row of conductors 2, and each second signal conductor S2 of each row of conductors 2 is not opposite to any one of the other row of conductors 2, thereby facilitating the anti-crosstalk interference effect of the electrical connector 100.

Referring to FIG. 1 and FIG. 5, the electrical connector 100 further has two grounding members 3 formed by stamping a metal sheet. Each grounding member 3 has a main body portion 30. Each main body portion 30 is provided in the left-right direction X lengthwise. Each main body portion 30 is provided at the outer sides of the fixing portions 21 of each row of conductors 2. A plurality of elastic sheets 31 extend from the upper edge of the main body portion 30. Each elastic sheet 31 abuts the outer side of the corresponding fixing portion 21. Each grounding member 3 is used to electrically connect all the ground conductors G of each row of conductors 2.

Figure 14:
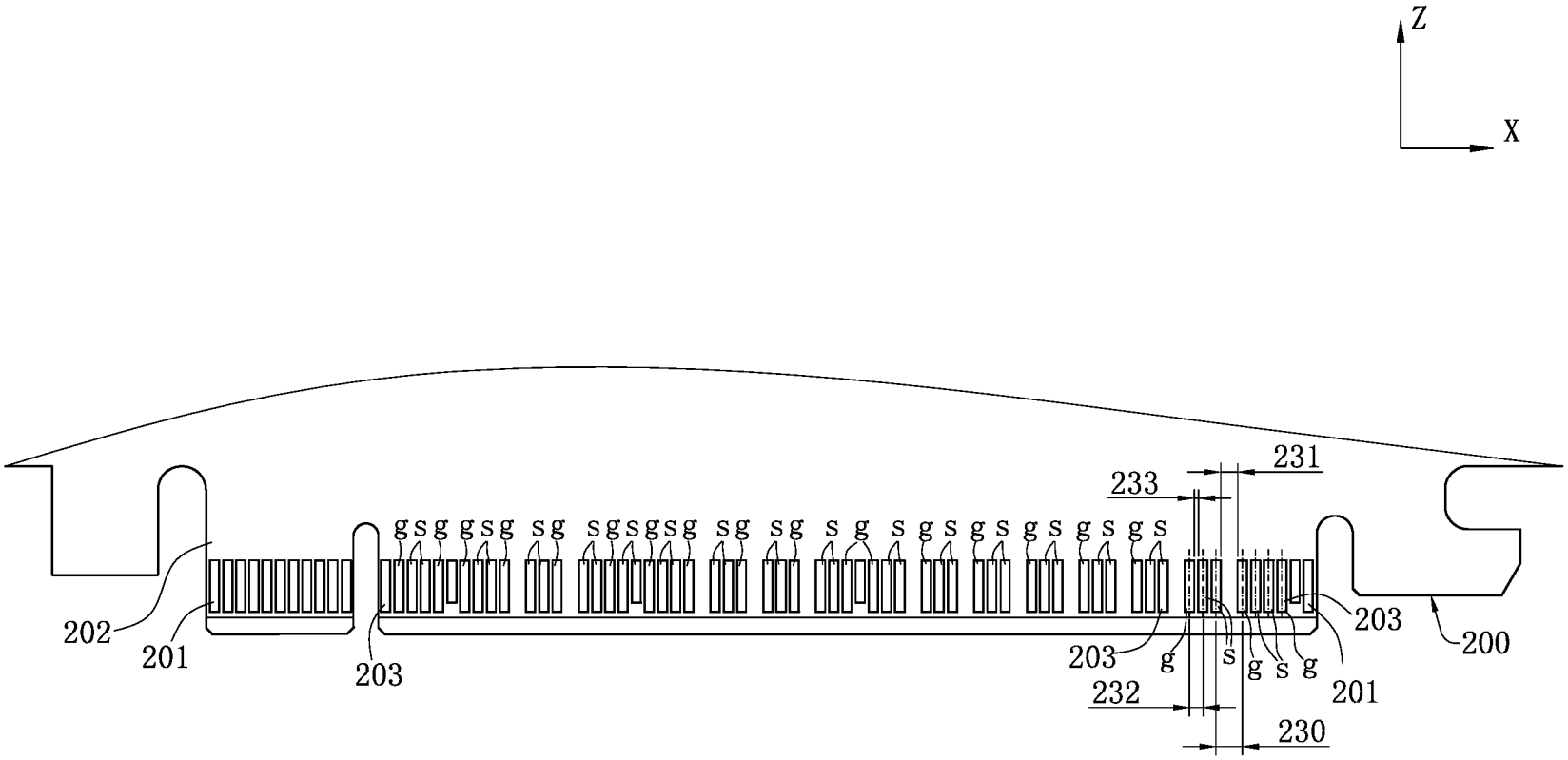
FIG. 14 is a plain view of an electronic card mated with the electrical connector according to the first embodiment of the present invention.

Referring to FIG. 1 and FIG. 14, an insertion end 202 is formed at the lower end of the electronic card 200 to be inserted into the insertion slot 10. The two rows of pads 201 are respectively provided on the plate surfaces at two sides of the insertion end 202 in parallel. Each row of pads 201 have a plurality of pairs of signal pads s and a plurality of grounding pads g. Each pad 201 has a conduction portion 203 electrically connected with a corresponding contact portion 23. The conduction portion 203 of each signal pad 201 is electrically connected with the contact portion 23 of each signal conductor S, thereby facilitating the signal transmission. The conduction portion 203 of each grounding pad 201 is electrically conducted with each ground conductor G. In the four pads 201 corresponding to each conductive unit T, two of the pads 201 are a pair of signal pads s provided adjacent to each other, and the other two pads 201 are grounding pads g. The two grounding pads g are respectively provided at two sides of the pair of signal pads s. The first contact interval 231 and the first contact center distance 230 are defined between the conduction portion 203 of one signal pad s and the conduction portion 203 of its adjacent grounding pad g, and the second contact interval 233 and the second contact center distance 232 are defined between the conduction portion 203 of the other signal pad s and the conduction portion 203 of its adjacent grounding pad g. It can be seen from the above electrical connector 100 that the first contact center distance 230 is greater than the second contact center distance 232, and the first contact interval 231 is great than the second contact interval 233, thus adjusting the height-frequency performance of the electronic card 200.

FIG. 15 to FIG. 20 show a second embodiment of the present invention. The difference between the electrical connector 100 of the second embodiment and the electrical connector 100 of the first embodiment exists as below. Referring to the electrical connector 100 of FIG. 15, FIG. 16 and FIG. 17, no fool-proof rib 14 is provided in the insertion slot 10, and the insertion slot 10 is provided in communication in the left-right direction lengthwise. The first row of conductors 2A and the second row of conductors 2B are respectively provided on the first side wall 11 and the second side wall 12 forming the insertion slot 10. The first row of conductors 2A and the second row of conductors 2B are both formed by sequentially continuously arranging a plurality of conductive units T in the left-right direction X. Each two adjacent conductive units T in the left-right direction X share a ground conductor G. The insulating body 1 further includes a plurality of insulating blocks 17. The fixing portions 21 of each row of conductors 2 are injection-molded with one insulating block 17. The connecting portions 22 of each row of conductors 2 extend upward out of the upper surface of the corresponding insulating block 17, and the tail portions 24 of each row of conductors 2 extend downward out of the lower surface of the corresponding insulating block 17. Two mounting slots (not shown, same below) are upward concavely provided from the insulating body 1. One of the mounting slots is located below the first side wall 11, and is in upward communication with a row of conductor slots 15. The other of the mounting slots is located below the second side wall 12, and is in upward communication with a row of conductor slots 15. Each insulating block 17 is accommodated in a corresponding mounting slot. The connecting portions 22 of each row of conductors 2 extend upward out of the upper surface of the corresponding insulating block 17, and are one-to-one accommodated in the corresponding conductor slots 15 of the first side wall 11 or the second side wall 12. The tail portions 24 of each row of conductors 2 extend downward out of the lower surface of the insulating body 1 to be soldered and fixed to the circuit board 300. All the tail portions 24 of each row of conductors 2 are provided in a row, and the two rows of tail portions 24 extend horizontally in the width direction Y respectively.

Figure 18:
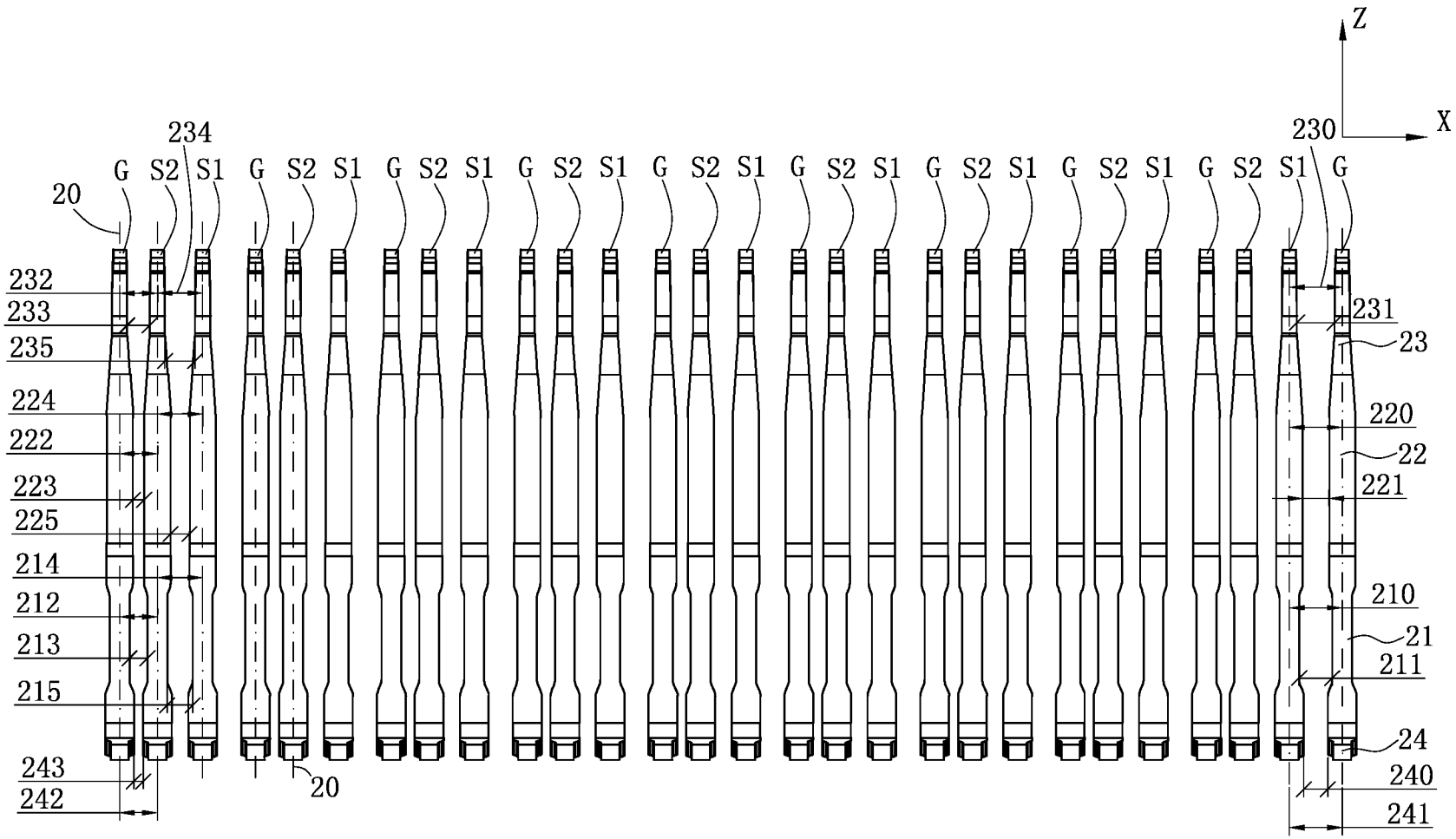
FIG. 18 is a schematic plain view of a first row of conductors of the electrical connector according to the second embodiment of the present invention viewing along the width direction.
Figure 19:
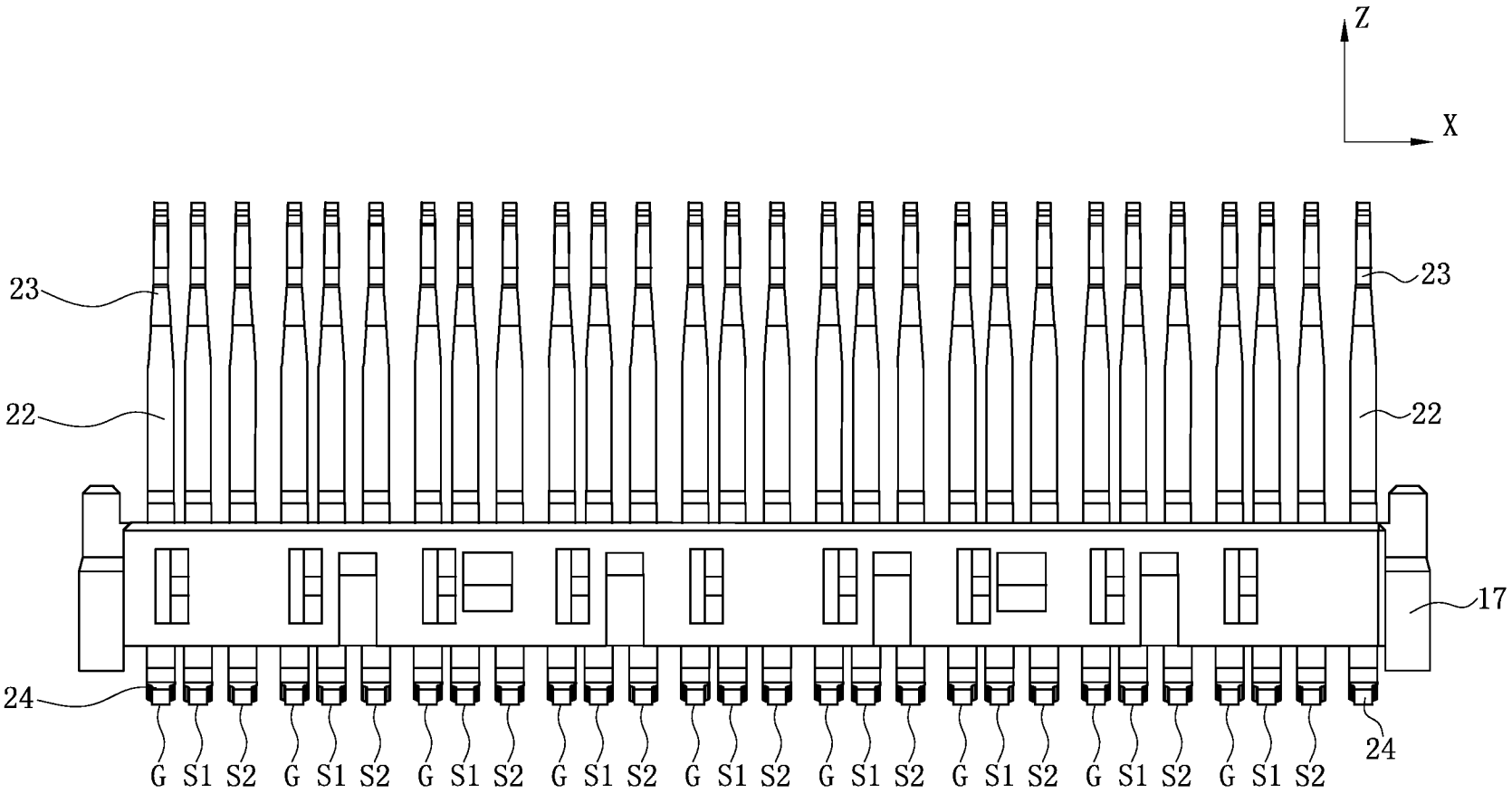
FIG. 19 is a schematic plain view of a first row of conductors fixed to insulating blocks of the electrical connector according to the second embodiment of the present invention viewing along the width direction.
Figure 20:
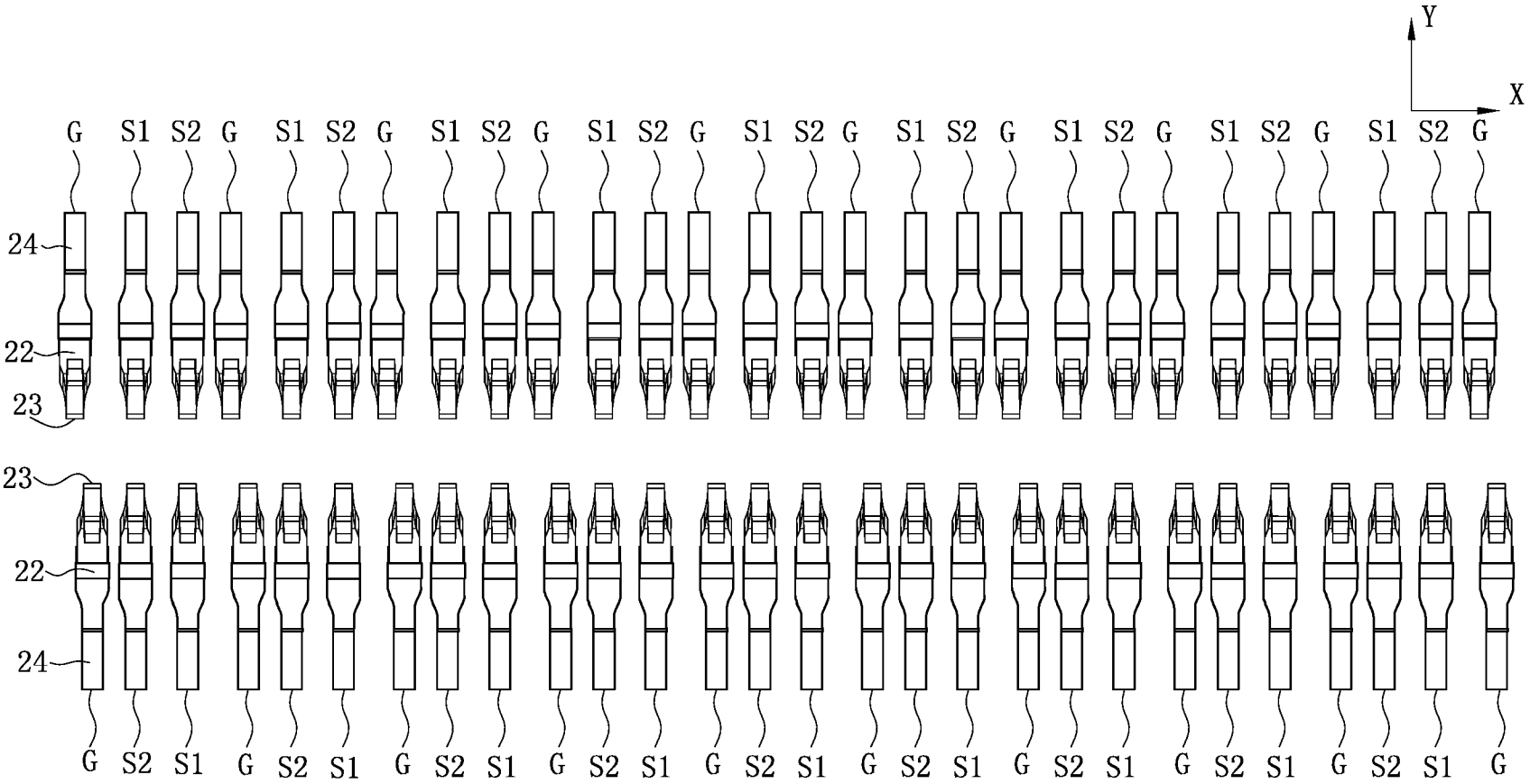
FIG. 20 is a schematic plain view of the first row of conductors and a second row of conductors of the electrical connector according to the second embodiment of the present invention viewing downward from top thereof.
Figure 21:
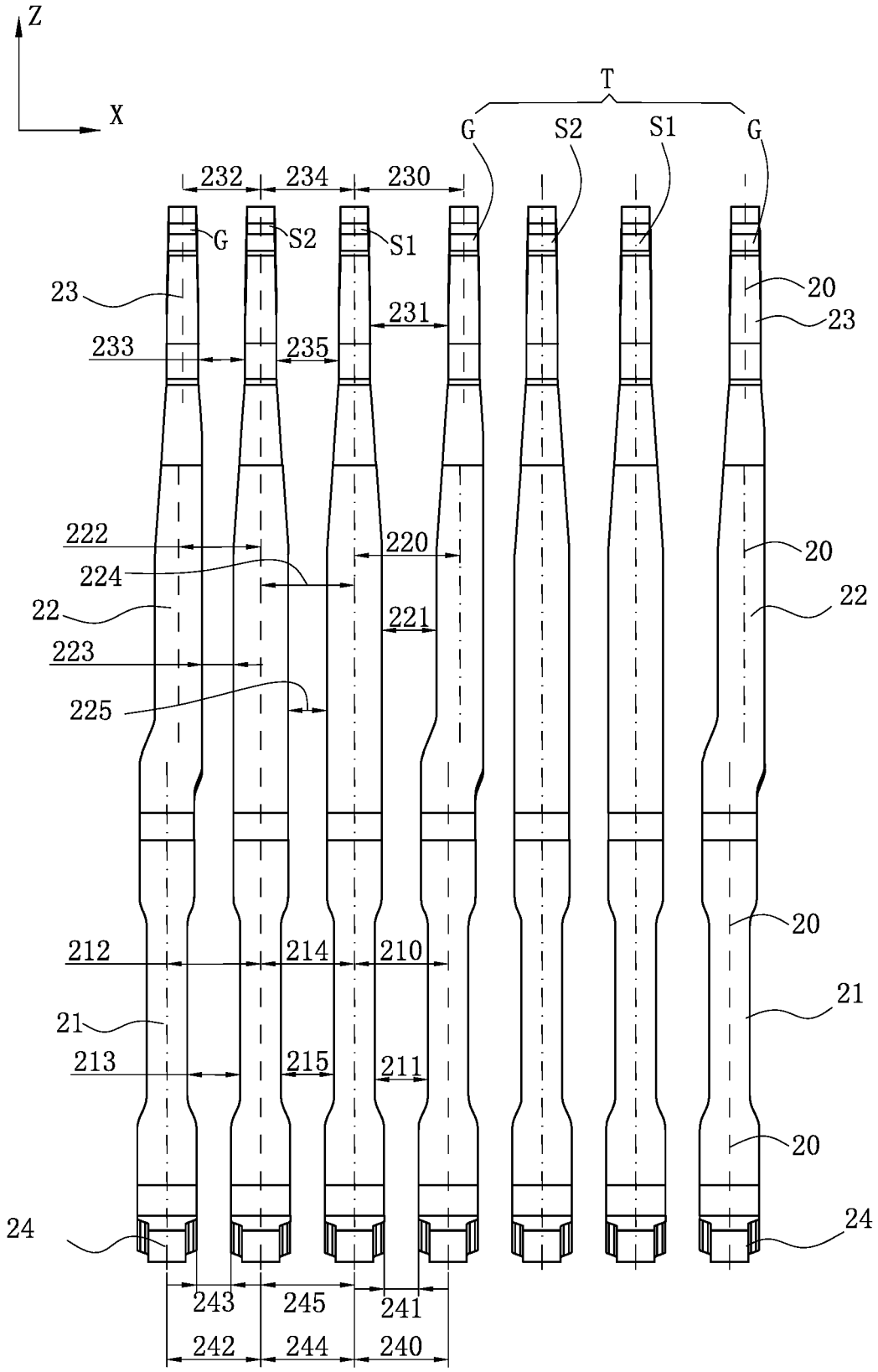
FIG. 21 is a schematic plain view of a first row of conductors of the electrical connector according to a third embodiment of the present invention viewing along the width direction.

Referring to FIG. 18, FIG. 19 and FIG. 20, each row of conductors 2 are formed by the plurality of conductive units T continuously arranged rightward from left thereof. In each conductive unit T, along a same horizontal cross section, the first contact center distance 230 is greater than the third contact center distance 234, which is greater than the second contact center distance 232; the first contact interval 231 is greater than the third contact interval 235, which is greater than the second contact interval 233; the first connecting center distance 220 is greater than the third connecting center distance 224, which is greater than the second connecting center distance 222; the first connecting interval 221 is greater than the third connecting interval 225, which is greater than the second connecting interval 223; the first fixing center distance 210 is greater than the third fixing center distance 214, which is greater than the second fixing center distance 212; the first fixing interval 211 is greater than the third fixing interval 215, which is greater than the second fixing interval 213; the first tail portion center distance 240 is greater than the third tail portion center distance 244, which is greater than the second tail portion center distance 242; and the first tail interval 241 is greater than the third tail interval 245, which is greater than the second tail interval 243, such that the electrical connector 100 achieves an ideal high-frequency effect.

Figure 15:
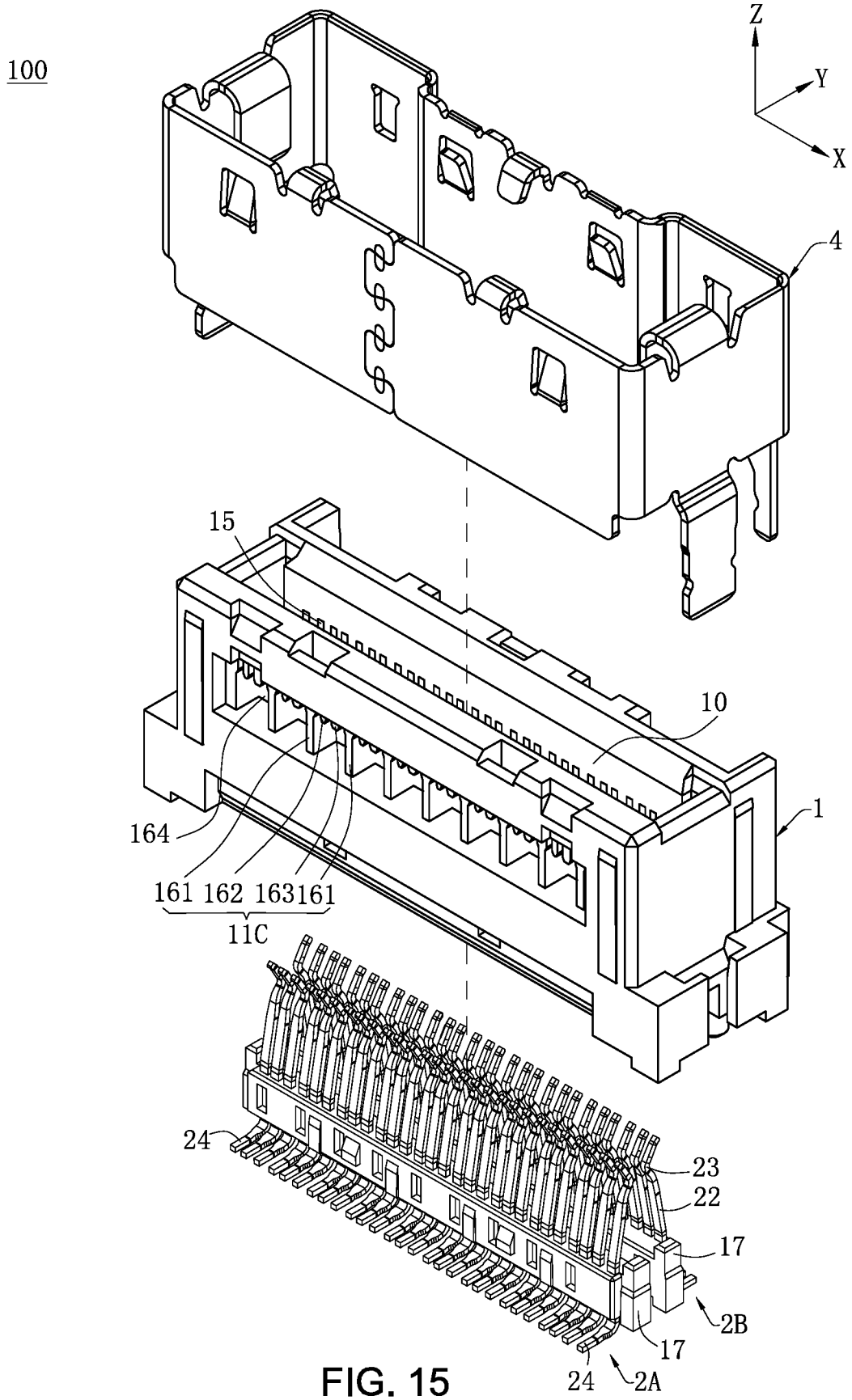
FIG. 15 is a perspective exploded view of an electrical connector according to a second embodiment of the present invention.
Figure 16:
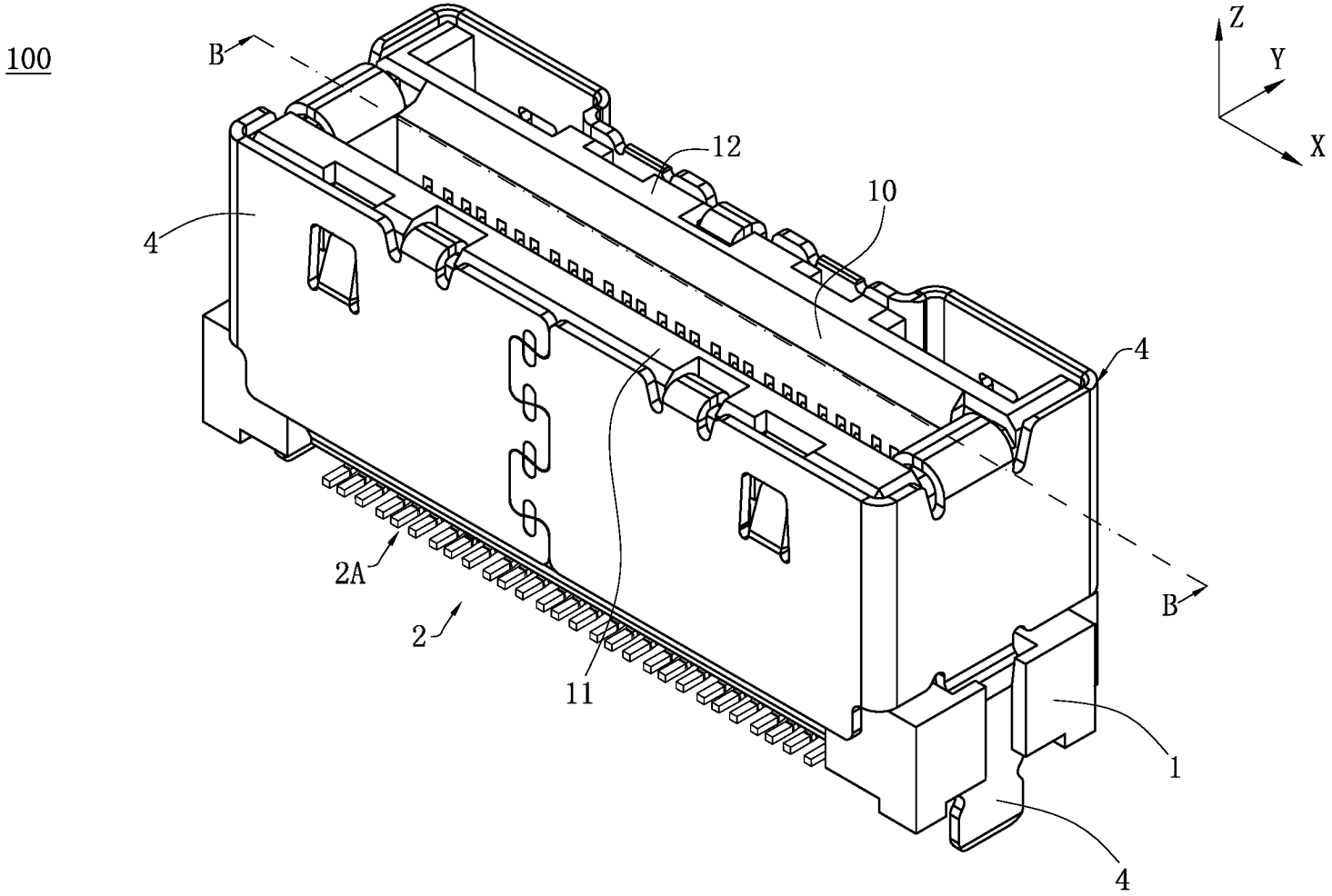
FIG. 16 is a perspective assembled view of the electrical connector according to the second embodiment of the present invention.
Figure 17:
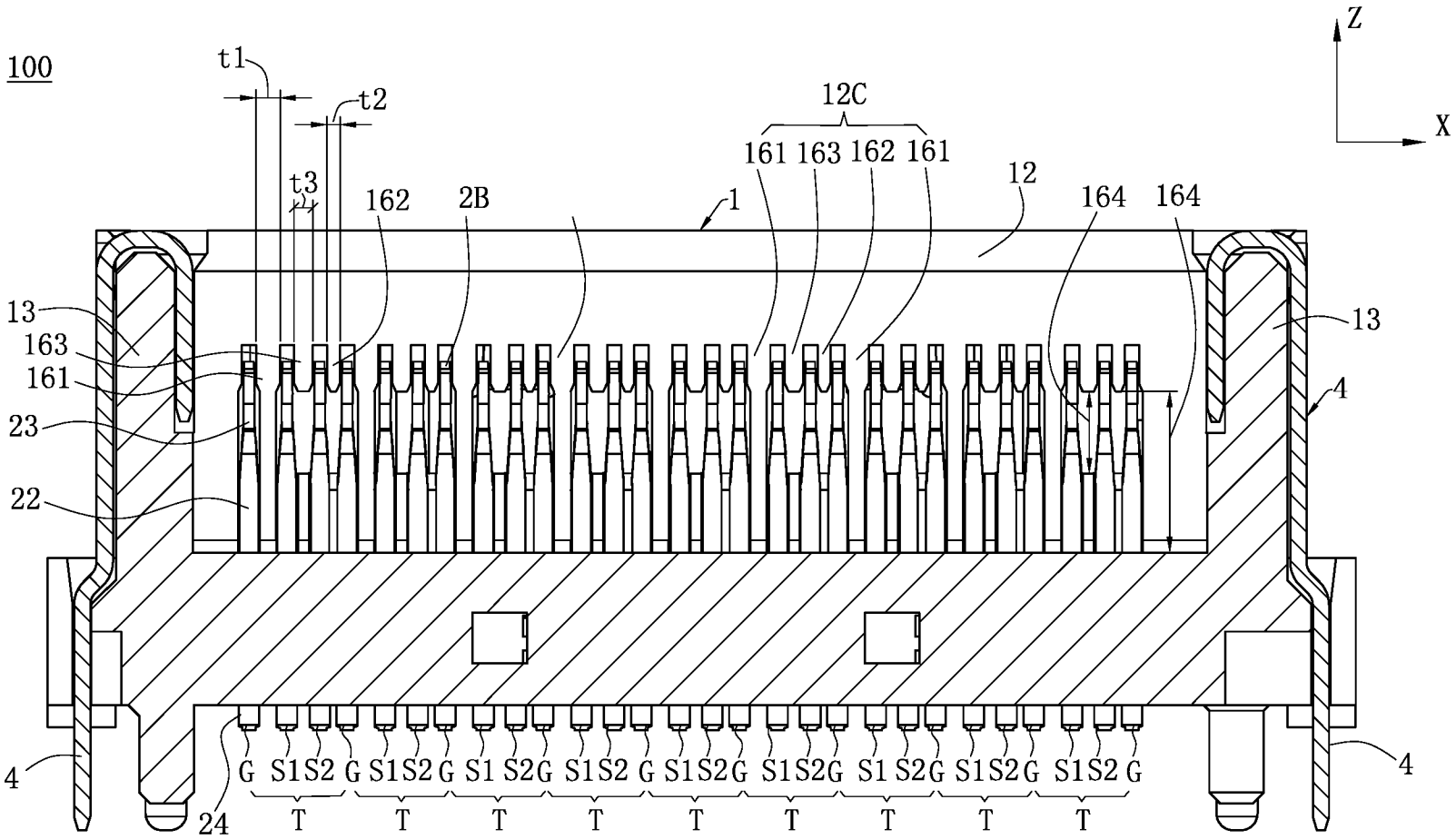
FIG. 17 is a plain sectional view of FIG. 16 along a line B-B.

Referring to FIG. 15, FIG. 16 and FIG. 17, each conductor slot 15 does not run upward through the upper surface of the insulating body 1. The first side wall 11 has a plurality of first combined walls 11C, and the second side wall 12 has a plurality of second combined walls 12C. Each first combined wall 11C and each second combined wall 12C is formed by two adjacent first thick walls 161, and a first thin wall 162 and a second thin wall 163 located between the two adjacent first thick walls 161. Each first thick walls 161 defines a first thickness t1, the first thin wall 162 defines a second thickness t2, and the third thin wall defines a third thickness t3. The first thickness t1 is greater than the third thickness t3, which is greater than the second thickness t2. Each first combined wall 11C or each second combined wall 12C corresponds to a conductive unit T. The first signal conductor S1 and its adjacent ground conductor G are partitioned by a first thick wall 161. There is a first thin wall 162 between the second signal conductor S2 and the adjacent ground conductor G. There is a second thin wall 163 between the pair of first signal conductor S1 and second signal conductor S2. The first thick wall 161 is not provided with a window 164, and the conductor slots 15 located at two sides of the first thick wall 161 are not in communication with each other in the left-right direction. The first thin wall 162 has a window 164, and the conductor slots 15 located at the left and right sides of the first thin wall 162 are in air communication in the left-right direction. The second thin wall 163 has a window 164, and the conductor slots 15 located on the left and right sides of the second thin wall 163 are in air communication in the left-right direction. The dimension of the window 164 of the first thin wall 162 is greater than the dimension of the second window 164, such that the first average dielectric coefficient ε1 is greater than the second average dielectric coefficient ε2, which is greater than the third average dielectric coefficient ε3, thus adjusting the high-frequency characteristic of the conductive unit T. In the width direction Y, each pair of signal conductors S on the first side wall 11 and each pair of signal conductors S on the second side wall 12 are provided to be one-to-one opposite to each other, and each ground conductor G on the first side wall 11 and each ground conductor G on the second side wall 12 are staggered one-to-one, thus increasing an average distance from the ground conductor G on the first side wall 11 to the ground conductor G on the second side wall 12, and reducing the ground resonance of the electrical connector 100. A metal shell 4 wraps the insulating body 1 to shield the high-frequency signal. In addition, other structures of the second embodiment are similar to those of the first embodiment, and are thus not elaborated herein.

FIG. 21 to FIG. 24 show an electrical connector 100 according to a third embodiment of the present invention. The difference between the third embodiment and the second embodiment exists in that: in the third embodiment, referring to FIG. 21, which a plain view of two adjacent conductive units T. The virtual center line 20 of the connecting portion 22 of each ground conductor G is deviated in the left-right direction X relative to the virtual center line 20 of the fixing portion 21, and the virtual center line 20 of the contact portion 23 of each ground conductor G is deviated in the left-right direction X relative to the virtual center line 20 of the connecting portion 22. The fixing portion 21 and the tail portion 24 extend in a straight line without deviation. In each conductive unit T, along a same horizontal cross section, the first contact center distance 230 is greater than the third contact center distance 234, which is greater than the second contact center distance 232; the first contact interval 231 is greater than the third contact interval 235, which is greater than the second contact interval 233; the first connecting center distance 220 is greater than the third connecting center distance 224, which is greater than the second connecting center distance 222; and the first connecting interval 221 is greater than the third connecting interval 225, which is greater than the second connecting interval 223; the first fixing center distance 210 is equal to the third fixing center distance 214, which is equal to the second fixing center distance 212; the first fixing interval 211 is equal to the third fixing interval 215, which is equal to the second fixing interval 213; the first tail portion center distance 240 is equal to the third tail portion center distance 244, which is equal to the second tail portion center distance 242; and the first tail interval 241 is equal to the third tail interval 245, which is equal to the second tail interval 243 such that the electrical connector 100 achieves an ideal high-frequency effect.

Figure 22:
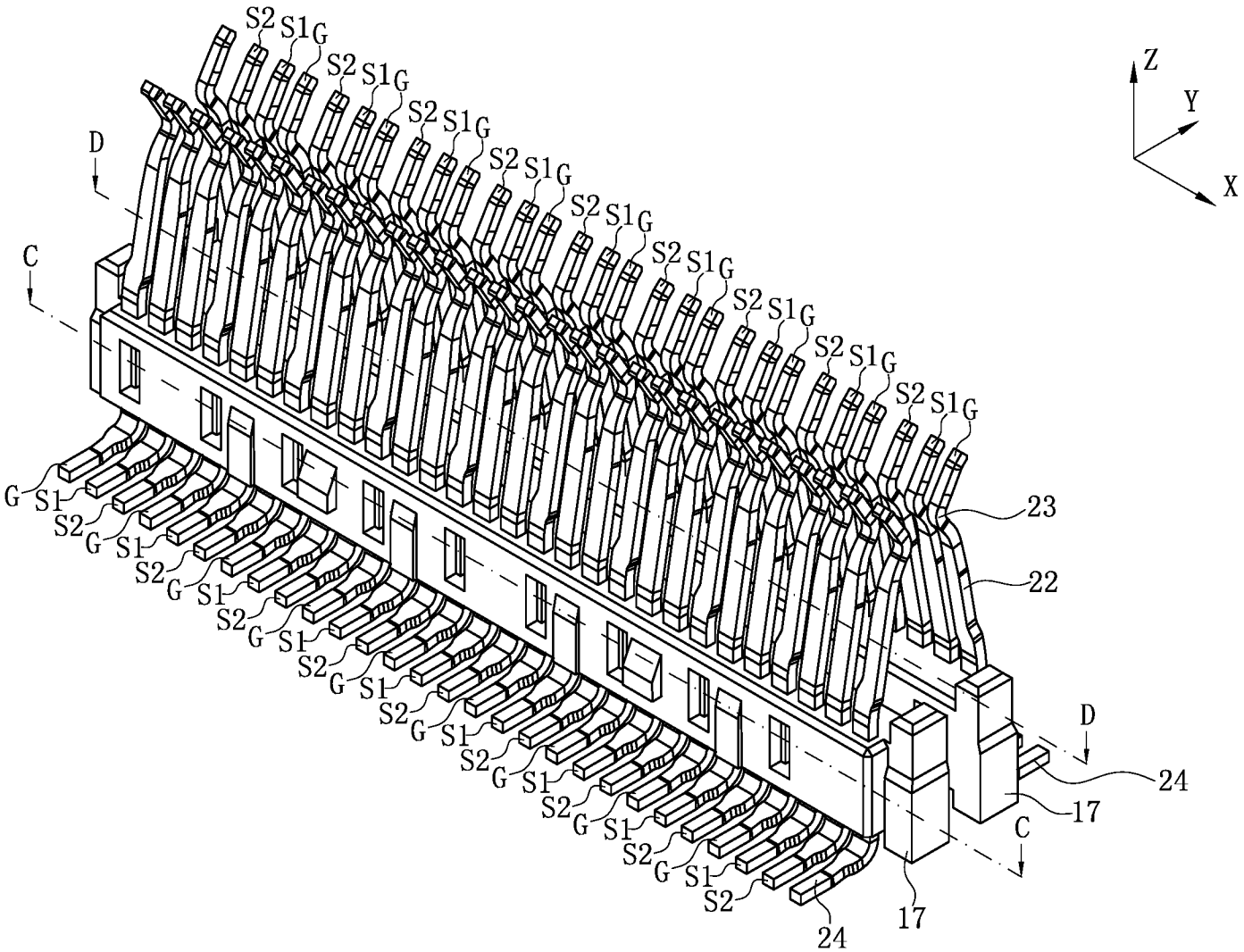
FIG. 22 is a perspective schematic view of the first row of conductors and a second row of conductors of the electrical connector according to the third embodiment of the present invention.
Figure 23:
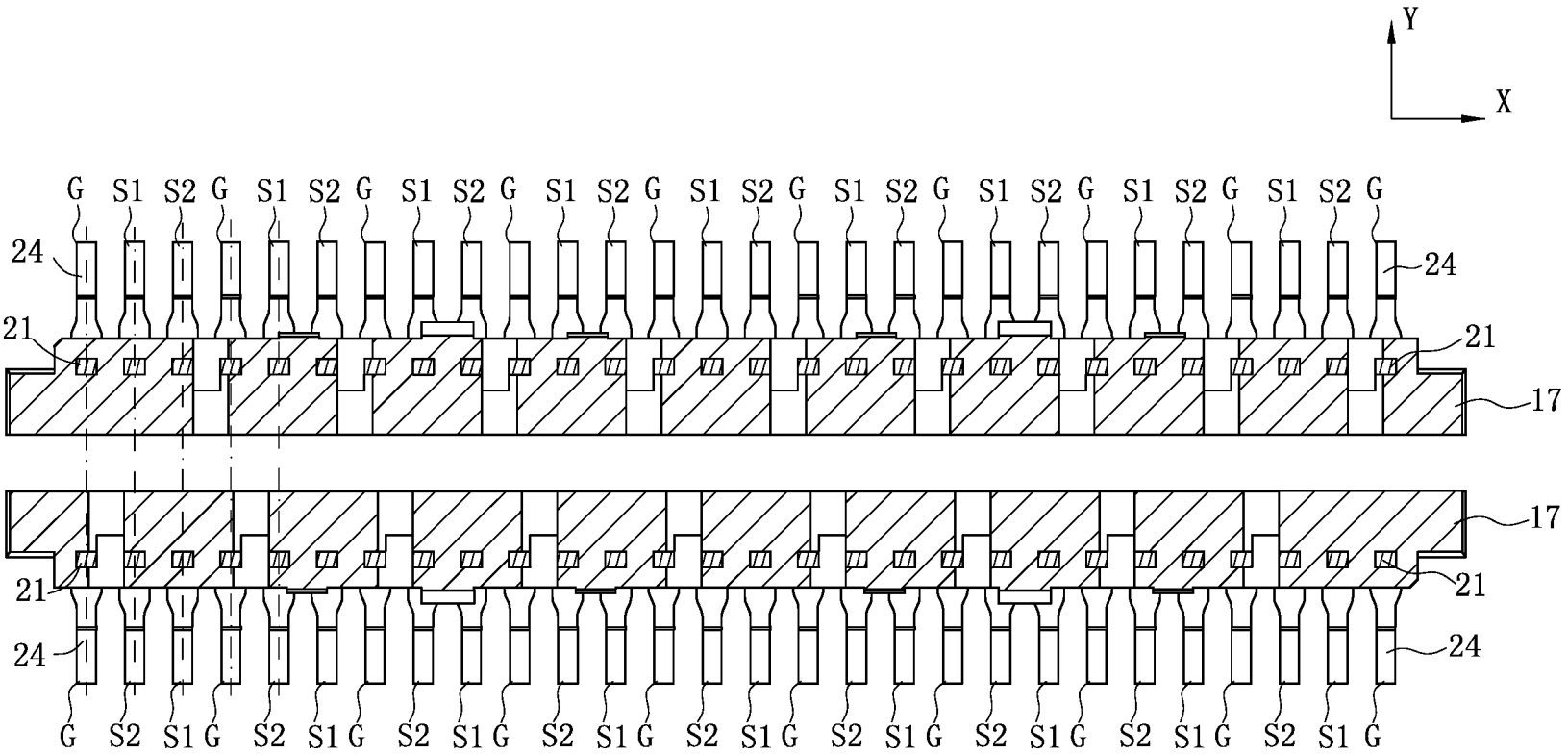
FIG. 23 is a plain sectional view of FIG. 22 along a line C-C.
Figure 24:
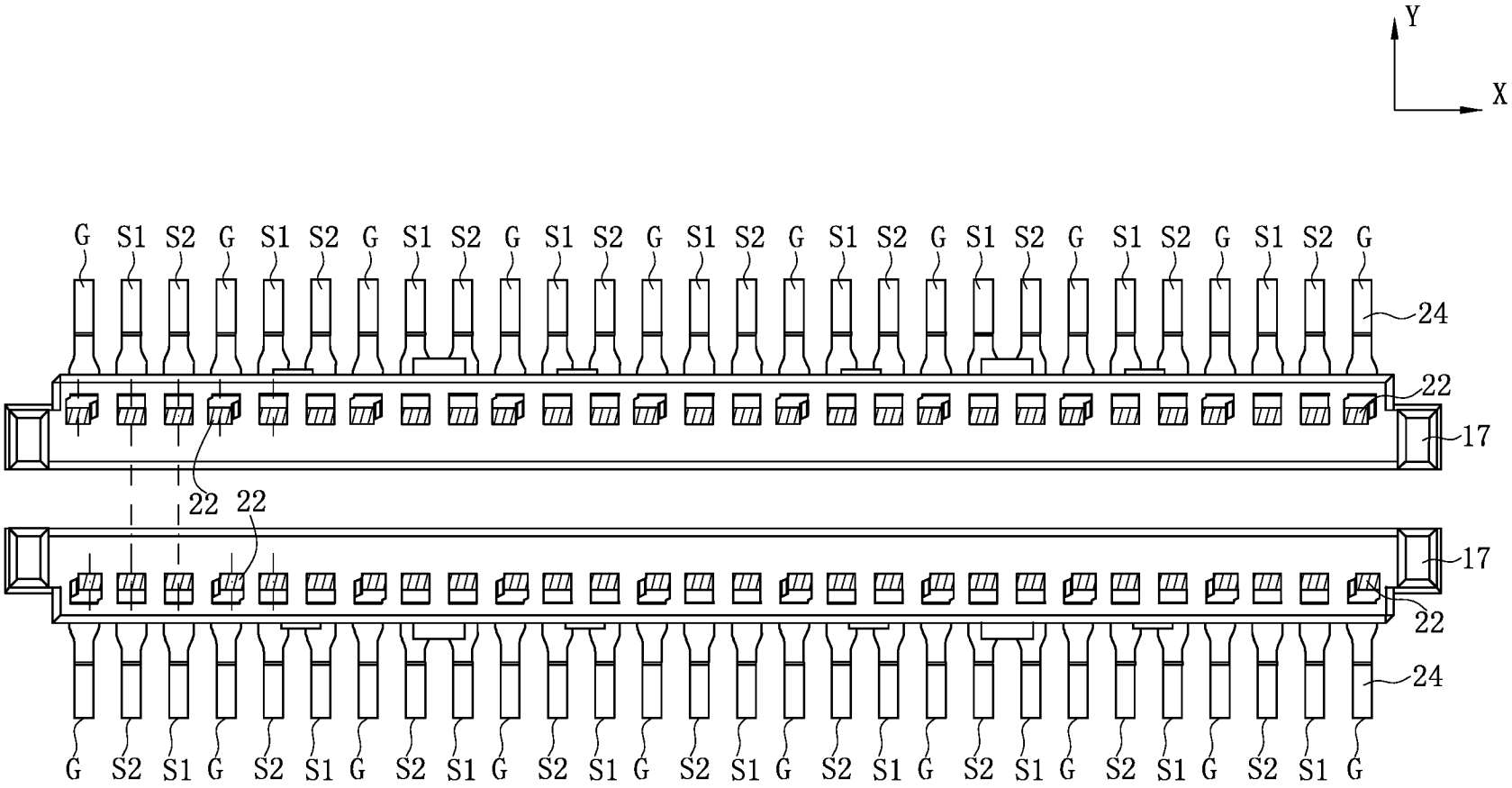
FIG. 24 is a plain sectional view of FIG. 22 along a line D-D.

Referring to FIG. 22 and FIG. 23, in the width direction Y, each pair of signal conductors S of the first row of conductors 2A and each pair of signal conductors S of the second row of conductors 2 face each other one-to-one. Referring to FIG. 22 and FIG. 24, the fixing portion 21 of each ground conductor G of the first row of conductors 2A and the fixing portion 21 of each ground conductor G of the second row of conductors 2B face each other one-to-one. The connecting portion 22 of each ground conductor G of the first row of conductors 2A and the connecting portion 22 of each ground conductor G of the second row of conductors 2B are staggered one-to-one, and are deviated in opposite directions in the left-right direction X. By increasing the average distances from the ground conductors G of the first row of conductors 2A to the ground conductors G of the second row of conductors 2B, the ground resonance of the electrical connector 100 is reduced. Other structures of the third embodiment are similar to those of the second embodiment, and are thus not elaborated herein.

To sum up, the electrical connector according to certain embodiments of the present invention has the following beneficial effects:

1. The high-frequency signal of the electronic card 200 is transmitted to the conductors 2 through the contact portions 23. Insertion loss may be generated in the process of transmitting the high-frequency signal of the electronic card 200 to the conductors 2. The resonance of the ground conductors G is a factor that affects the insertion loss. Compared with the related art where a row of terminals are provided at equal center distances and equal intervals, in the electrical connector 100 of the present embodiment, the first contact center distance 230 is greater than the second contact center distance 232 and the third contact center distance 234, and the first contact interval 231 is greater than the second contact interval 233 and the third contact interval 235, such that in each of the conductive units T, an average contact center distance and an average contact interval from the two ground conductors G to the pair of signal conductors S are increased, thereby reducing the resonance to the first signal conductor S1 from the adjacent ground conductor G.

2. Further, the second contact center distance 232 is equal to the third contact center distance 234, and the second contact interval 233 is equal to the third contact interval 235, such that the center distance between the two ground conductors G of each of the conductive units T is further increased, thereby reducing the overlapping of the interfering electromagnetic waves of the two ground conductors G of each of the conductive units T, and reducing the ground resonance.

3. Compared with the related art, in the present embodiment, the first contact interval 231 is greater than the second contact interval 233 and the third contact interval 235, and the second contact interval 233 is equal to the third contact interval 235, such that the impedance of each pair of signal conductors S is reduced. Thus, when the high-frequency signal is transmitted from the electronic card 200 to the conductors 2, the energy of the high-frequency signal is more easily transmitted through the pair of signal conductors S, thereby reducing the insertion loss, and facilitating the high-frequency performance. Meanwhile, more energy of the high-frequency signal is transmitted through the pair of signal conductors S. The pair of signal conductors S for transmitting a differential signal has anti-crosstalk characteristics. By having more energy to be transmitted through the pair of signal conductors S, the anti-crosstalk effect of the electrical connector 100 is better.

4. In the present embodiment, the first connecting center distance 220 is greater than the second connecting center distance 222 and the third connecting center distance 224, the second connecting center distance 222 is equal to the third connecting center distance 224, the first connecting interval 221 is greater than the second connecting interval 223, the second connecting interval 223 is equal to the third connecting interval 225, the first fixing center distance 210 is greater than the second fixing center distance 212, the second fixing center distance 212 is equal to the third fixing center distance 214, the first fixing interval 211 is greater than the second fixing interval 213, and the second fixing interval 213 is equal to the third fixing interval 215. Therefore, in each of the conductive units T, an average center distance and an average interval from the transmission intermediate paths of the pair of ground conductors G to the transmission intermediate paths of the pair of signal conductors S are increased, which reduces return loss of the pair of signal conductors S and is conductive to the attenuation of the high-frequency signal on the transmission path of the conductors 2.

5. The thickness of the first thick wall 161 is greater than the thickness of the first thin wall 162, such that the first average dielectric coefficient ci is greater than the second average dielectric coefficient ε2. Since the average center distances and the average intervals between the first signal conductor S1 and the adjacent ground conductor G are all greater than the average center distances and the average intervals between the second signal conductor S2 and the adjacent ground conductor G, the first average dielectric coefficient ε1 is greater than the second average dielectric coefficient ε2, thus balancing the capacitance between the pair of signal conductors S and between the ground conductors G at the two sides, and facilitating the coupling of the high-frequency signals between the pair of signal conductors S.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical module, electrically connected with an electronic component, the electrical module comprising:

a plurality of conductors, having a first row of conductors arranged along a left-right direction, wherein each of the conductors has a contact portion in contact with the electronic component, a distance between each two adjacent ones of the contact portions of the conductors in the left-right direction is defined as a contact interval, the first row of conductors have at least one pair of signal conductors and at least two ground conductors, each of a left adjacent side and a right adjacent side of the pair of signal conductors has one of the two ground conductors, the contact interval from one signal conductor of the pair of signal conductors to an adjacent one of the two ground conductors is defined as a first contact interval, the contact interval from the other signal conductor of the pair of signal conductors to the other adjacent one of the two ground conductors is defined as a second contact interval, and the first contact interval is not equal to the second contact interval; and an insulating body, fixing the first row of conductors.

2. The electrical module according to claim 1, wherein the contact interval between the pair of signal conductors is defined as a third contact interval, the first contact interval is greater than the second contact interval and also greater than the third contact interval, and the second contact interval is less than or equal to the third contact interval.

3. The electrical module according to claim 2, wherein a first average dielectric coefficient exists between one of the ground conductors and a corresponding one of the signal conductors defining the first contact interval therebetween, a second average dielectric coefficient exists between one of the ground conductors and a corresponding one of the signal conductors defining the second contact interval therebetween, and the first average dielectric coefficient is greater than the second average dielectric coefficient.

4. The electrical module according to claim 1, wherein the electrical module is an electrical connector, the electrical connector is mounted to a circuit board, the electronic component is an electronic card inserted into the electrical connector, and the electrical connector comprises:

the insulating body, comprising a first side wall and a second side wall provided opposite to each other, and an insertion slot located between the first side wall and the second side wall, wherein the insertion slot is configured for the electronic card to be inserted therein; and the first row of conductors, having a plurality of pairs of signal conductors and a plurality of ground conductors, wherein each of the left adjacent side and the right adjacent side of each pair of the pairs of the signal conductors has one of the ground conductors, the contact portions of the first row of conductors are arranged in one row on the first side wall in the left-right direction, each of the contact portions of the first row of conductors protrudes into the insertion slot, after being in contact with the electronic card, each of the contact portions of the first row of conductors generates an elastic displacement, and before and after the electronic card is inserted into the insertion slot, the first contact interval is greater than the second contact interval.

5. The electrical module according to claim 4, wherein the first side wall has a plurality of partition walls and a plurality of conductor slots, each of the conductor slots is configured to accommodate one of the conductors of the first row of conductors and is in communication with the insertion slot, one of the partition walls is defined between two adjacent ones of the conductor slots, each of the partition walls between one of the ground conductors and a corresponding one of the signal conductors defining the first contact interval therebetween has a first thickness, each of the partition walls between one of the ground conductors and a corresponding one of the signal conductors defining the second contact interval therebetween has a second thickness, and the first thickness is greater than the second thickness.

6. The electrical module according to claim 5, wherein each of the partition walls located between one of the pairs of signal conductors defines a third thickness, and the third thickness is equal to the second thickness.

7. The electrical module according to claim 6, wherein each of the signal conductors has a fixing portion and a connecting portion extending from the fixing portion, and the connecting portion is located between the contact portion and the fixing portion;

each respective partition wall of the partition walls located between the two signal conductors of one of the pairs of signal conductors has a window and two fastening slots, the window runs through the respective partition wall in the left-right direction, the two fastening slots are respectively provided at a left and a right side of the respective partition wall, each of the two fastening slots is a blind hole, and the two fastening slots are not in communication with each other in the left-right direction; and the two connecting portions of each of the pairs of signal conductors are located at a left adjacent side and a right adjacent side of the window, the two connecting portions are in air communication, the two fixing portions of each of the pairs of signal conductors are respectively fastened in the two fastening slots, and the two fixing portions are not in air communication.

8. The electrical module according to claim 3, wherein the first side wall has a row of conductor slots arranged in the left-right direction, each of the conductor slots is configured to correspondingly accommodate one of the conductors and is in communication with the insertion slot, the first side wall further comprises a plurality of windows configured to communicate two adjacent ones of the conductor slots in the left-right direction, none of the windows exists in two of the conductor slots corresponding to one of the ground conductors and a corresponding one of the signal conductors defining the first contact interval therebetween, and one of the window exists between two of the conductor slots corresponding to one of the ground conductors and a corresponding one of the signal conductors defining the second contact interval therebetween.

9. The electrical module according to claim 1, wherein each of the conductors has a fixing portion fixed to the insulating body and a tail portion extending out of the insulating body, the fixing portion is located between the contact portion and the tail portion, a distance between each two adjacent ones of the fixing portions of the conductors is defined as a fixing interval, the fixing interval between one of the signal conductors and a corresponding one of the ground conductors defining the first contact interval therebetween is defined as a first fixing interval, the fixing interval between the other of the signal conductors and a corresponding one of the ground conductors defining the second contact interval therebetween is defined as a second fixing interval, the first contact interval is greater than the second contact interval, and the first fixing interval is greater than or equal to the second fixing interval.

10. The electrical module according to claim 9, wherein a distance between each two adjacent ones of the tail portions is defined as a tail interval, the tail interval between the one of the signal conductors and the corresponding one of the ground conductors defining the first contact interval therebetween is defined as a first tail interval, the tail interval between the other of the signal conductors and the corresponding one of the ground conductors defining the second contact interval therebetween is defined as a second tail interval;

when the first fixing interval is greater than the second fixing interval, the first tail interval is greater than the second tail interval; and when the first fixing interval is equal to the second fixing interval, the first tail interval is equal to the second tail interval.

11. The electrical module according to claim 1, wherein a width direction is defined to be perpendicular to the left-right direction, the conductors further have a second row of conductors, the second row of conductors and the first row of conductors are parallel in the width direction and provided at intervals oppositely, the first row of conductors and the second row of conductors both have a plurality of pairs of signal conductors and a plurality of ground conductors, at least one of the pairs of signal conductors of the first row of conductors and at least one of the pairs of signal conductors of the second row of conductors are opposite to each other one-by-one in the width direction, and at least one of the ground conductors of the first row of conductors and at least one of the ground conductors of the second row of conductors are staggered one-by-one in the width direction.

12. The electrical module according to claim 1, wherein a width direction is defined to be perpendicular to the left-right direction, the conductors further form a second row of conductors, the second row of conductors and the first row of conductors are parallel in the width direction and provided at intervals oppositely, the first row of conductors and the second row of conductors both have a plurality of pairs of signal conductors and a plurality of ground conductors, and in at least one pair of the pairs of signal conductors of the first row of conductors, one of the one pair of signal conductors is opposite to one of the ground conductors of the second row of conductors in the width direction, and the other of the one pair of signal conductors is not opposite to any conductor of the second row of conductors in the width direction.

13. The electrical module according to claim 1, wherein the electrical module is an electronic card, the electronic component is an electrical connector configured for the electronic card to insert therein, the electronic card comprises an insertion end, configured to be inserted into the electrical module, the insertion end has two plate surfaces parallel and opposite to each other, and the first row of conductors are provided on one of the plate surfaces.

14. An electrical module, electrically connected with an electronic component, the electrical module comprising:

a plurality of conductors, having a first row of conductors arranged in a left-right direction, wherein each of the conductors has a contact portion in contact with the electronic component, a center distance between each two adjacent ones of the contact portions of the conductors in the left-right direction is defined as a contact center distance, the conductors have at least one ground unit and at least two pairs of signal conductors, each of the at least one ground unit is formed by at least one ground conductor, each of a left adjacent side and a right adjacent side of the ground unit is provided with a corresponding pair of the at least two pairs of signal conductors, the contact center distance from one of the at least one ground conductor of the ground unit to an adjacent signal conductor of the corresponding pair of the at least two pairs of signal conductors at one of the adjacent sides of the ground unit is defined as a first contact center distance, and the contact center distance from one of the at least one ground conductor of the ground unit to an adjacent signal conductor of the corresponding pair of the at least two pairs of signal conductors at the other of the adjacent sides of the ground unit is defined as a second contact center distance, and the first contact center distance is not equal to the second contact center distance; and an insulating body, fixing the first row of conductors.

15. The electrical module according to claim 14, wherein the contact center distance between each pair of the at least two pairs of signal conductors is equal and is defined as a third contact center distance, the first contact center distance is greater than the second contact center distance and also greater than the third contact center distance, and the second contact center distance is less than or equal to the third contact center distance.

16. The electrical module according to claim 14, wherein the electrical module is an electrical connector, the electrical connector is mounted to a circuit board, the electronic component is an electronic card inserted into the electrical connector, and the electrical connector comprises:

the insulating body, comprising a first side wall and a second side wall provided opposite to each other, and an insertion slot located between the first side wall and the second side wall, wherein the insertion slot is configured for the electronic card to be inserted therein; and the first row of conductors, having a plurality of pairs of signal conductors and a plurality of ground conductors, wherein each of a left adjacent side and a right adjacent side of each of the ground units is provided with one pair of signal conductors, the contact portions of the first row of conductors are arranged in one row on the first side wall in the left-right direction, each of the contact portions of the first row of conductors protrudes into the insertion slot, after being in contact with the electronic card, each of the contact portions of the first row of conductors generates an elastic displacement, and before and after the electronic card is inserted into the insertion slot, the first contact center distance is greater than the second contact center distance.

17. The electrical module according to claim 16, wherein the first side wall has a plurality of partition walls and a plurality of conductor slot, each of the conductor slots is in communication with the insertion slot and is configured to accommodate each of the first row of conductors, one of the partition walls is defined between two adjacent ones of the conductor slots, each of the partition walls between one of the ground conductors and a corresponding one of the signal conductors defining the first contact center distance therebetween has a first thickness, each of the partition walls between one of the ground conductors and a corresponding one of the signal conductors defining the second contact center distance therebetween has a second thickness, and the first thickness is greater than the second thickness.

18. The electrical module according to claim 17, wherein each of the partition walls located between one of the pairs of signal conductors defines a third thickness, and the third thickness is equal to the second thickness.

19. The electrical module according to claim 18, wherein each of the signal conductors has a fixing portion and a connecting portion extending from the fixing portion, and the connecting portion is located between the contact portion and the fixing portion;

each respective partition wall of the partition walls located between one of the pairs of signal conductors has a window and two fastening slots, the window is located between the two connecting portions and runs through the respective partition wall in the left-right direction, the two fastening slots are respectively provided at a left and a right side of the respective partition wall, each of the two fastening slots is fastened and matched with one of the fixing portions of the one of the pairs of signal conductors, each of the two fastening slots is a blind hole, and the two fastening slots are not in communication with each other in the left-right direction.

20. The electrical module according to claim 16, wherein the first side wall has a row of conductor slots arranged in the left-right direction, each of the conductor slots is in communication with the insertion slot and is configured to correspondingly accommodate each of the first row of conductors, the first side wall further comprises a plurality of windows configured to communicate two adjacent ones of the conductor slots in the left-right direction, none of the windows exists in two of the conductor slots corresponding to one of the ground conductors and a corresponding one of the signal conductors defining the first contact center distance therebetween, and one of the window exists between two of the conductor slots corresponding to one of the ground conductors and a corresponding one of the signal conductors defining the second contact center distance therebetween.

21. The electrical module according to claim 14, wherein each of the conductors has a fixing portion fixed to the insulating body and a tail portion extending out of the insulating body, the fixing portion is located between the contact portion and the tail portion, a center distance between each two adjacent ones of the fixing portions of the conductors is defined as a fixing center distance, the fixing center distance between one of the signal conductors and a corresponding one of the ground conductors defining the first contact center distance therebetween is defined as a first fixing center distance, the fixing center distance between the other of the signal conductors and a corresponding one of the ground conductors defining the second contact center distance therebetween is defined as a second fixing center distance, the first contact center distance is greater than the second contact center distance, and the first fixing center distance is greater than or equal to the second fixing center distance.

22. The electrical module according to claim 21, wherein a center distance between each two adjacent ones of the tail portions is defined as a tail center distance, the tail center distance between the one of the signal conductors and the corresponding one of the ground conductors defining the first contact center distance therebetween is defined as a first tail center distance, the tail center distance between the other of the signal conductors and the corresponding one of the ground conductors defining the second contact center distance therebetween is defined as a second tail center distance;

when the first fixing center distance is greater than the second fixing center distance, the first tail center distance is greater than the second tail center distance; and when the first fixing center distance is equal to the second fixing center distance, the first tail center distance is equal to the second tail center distance.

23. The electrical module according to claim 14, wherein a width direction is defined to be perpendicular to the left-right direction, the conductors further have a second row of conductors, the second row of conductors and the first row of conductors are parallel in the width direction and provided at intervals oppositely, the first row of conductors and the second row of conductors both have a plurality of pairs of signal conductors and a plurality of ground units, at least one of the pairs of signal conductors of the first row of conductors and at least one of the pairs of signal conductors of the second row of conductors are opposite to each other one-by-one in the width direction, and at least one of the ground units of the first row of conductors and at least one of the ground units of the second row of conductors are staggered one-by-one in the width direction.

24. The electrical module according to claim 14, wherein a width direction is defined to be perpendicular to the left-right direction, the conductors further form a second row of conductors, the second row of conductors and the first row of conductors are parallel in the width direction and provided at intervals oppositely, the first row of conductors and the second row of conductors both have a plurality of pairs of signal conductors and a plurality of ground units, each of the ground units only has one ground conductor, and in at least one pair of the pairs of signal conductors of the first row of conductors, one of the one pair of signal conductors is opposite to one of the ground units of the second row of conductors in the width direction, and the other of the one pair of signal conductors is not opposite to any conductor of the second row of conductors in the width direction.

25. The electrical module according to claim 14, wherein the electrical module is an electronic card, the electronic component is an electrical connector configured for the electronic card to insert therein, the electronic card comprises an insertion end, configured to be inserted into the electrical module, the insertion end has two plate surfaces parallel and opposite to each other, and the first row of conductors are provided on one of the plate surfaces.

* * * * *